US010476167B2

(12) United States Patent
Ayala Vazquez et al.

(10) Patent No.: US 10,476,167 B2
(45) Date of Patent: Nov. 12, 2019

(54) ADJUSTABLE MULTIPLE-INPUT AND MULTIPLE-OUTPUT ANTENNA STRUCTURES

(71) Applicant: Apple Inc., Cupertino, CA (US)

(72) Inventors: Enrique Ayala Vazquez, Watsonville, CA (US); Nanbo Jin, Milpitas, CA (US); Hongfei Hu, Santa Clara, CA (US); Han Wang, Cupertino, CA (US); Erdinc Irci, Sunnyvale, CA (US); Erica J. Tong, Pacifica, CA (US); Matthew A. Mow, Los Altos, CA (US); Ming-Ju Tsai, Sunnyvale, CA (US); Liang Han, Sunnyvale, CA (US); Georgios Atmatzakis, Cupertino, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 239 days.

(21) Appl. No.: 15/655,660

(22) Filed: Jul. 20, 2017

(65) Prior Publication Data

US 2019/0027833 A1 Jan. 24, 2019

(51) Int. Cl.
*H01Q 21/00* (2006.01)
*H01Q 5/35* (2015.01)
(Continued)

(52) U.S. Cl.
CPC ..... *H01Q 21/0006* (2013.01); *H01Q 1/243* (2013.01); *H01Q 1/48* (2013.01);
(Continued)

(58) Field of Classification Search
CPC ..... H01Q 5/35; H01Q 1/243; H01Q 21/0006; H01Q 5/342; H01Q 9/145; H01Q 9/42; H01Q 21/28; H01Q 1/48
See application file for complete search history.

(56) References Cited

U.S. PATENT DOCUMENTS 1,576,433 A * 3/1926 Bragg ..... B60K 25/04 123/198 R
8,350,761 B2 1/2013 Hill et al.
(Continued)

FOREIGN PATENT DOCUMENTS

JP 2013535117 A 9/2013

OTHER PUBLICATIONS

Enrique Ayala Vazquez et al., U.S. Appl. No. 15/657,001, filed Jul. 21, 2017.
(Continued)

*Primary Examiner* — Graham P Smith
*Assistant Examiner* — Jae K Kim
(74) *Attorney, Agent, or Firm* — Treyz Law Group, P.C.; Michael H. Lyons

(57) ABSTRACT

An electronic device may include antennas, a ground, and a housing. First and second gaps in the housing may define a segment that forms a resonating element for a first antenna. First, second, third, and fourth antenna feeds may be coupled between the segment and ground. Control circuitry may control adjustable components to place the device in first, second, third, or fourth modes. In the first and second modes, the first and fourth feeds convey signals at the same frequency using a multiple-input and multiple-output scheme while the second and third feeds are inactive. In the third mode, the second feed is active and the first, third, and fourth feeds are inactive. In the fourth mode, the third feed is active and the first, second, and fourth antenna feeds are inactive. Isolating return paths may be coupled between the segment and ground in the first and second modes.

20 Claims, 13 Drawing Sheets

(51) Int. Cl.

| | |
|---|---|
| ***H01Q 1/24*** | (2006.01) |
| ***H01Q 1/48*** | (2006.01) |
| ***H01Q 9/14*** | (2006.01) |
| ***H01Q 9/42*** | (2006.01) |
| ***H01Q 21/28*** | (2006.01) |
| ***H01Q 5/342*** | (2015.01) |

(52) U.S. Cl.
CPC ..... *H01Q 5/342* (2015.01); *H01Q 5/35* (2015.01); *H01Q 9/145* (2013.01); *H01Q 9/42* (2013.01); *H01Q 21/28* (2013.01)

(56) References Cited

U.S. PATENT DOCUMENTS

| | | | | |
|---|---|---|---|---|
| 9,337,539 | B1 | 5/2016 | Ananthanarayanan et al. | |
| 9,461,371 | B2 | 10/2016 | Kuonanoja | |
| 9,608,329 | B2 | 3/2017 | Liu et al. | |
| 9,653,813 | B2 | 5/2017 | Smith et al. | |
| 9,673,507 | B2 | 6/2017 | Ramachandran et al. | |
| 9,680,212 | B2 | 6/2017 | Konu et al. | |
| 9,698,483 | B2 | 7/2017 | Liu et al. | |
| 2010/0007564 | A1 | 1/2010 | Hill et al. | |
| 2012/0009983 | A1 | 1/2012 | Mow et al. | |
| 2014/0192845 | A1 | 7/2014 | Szini et al. | |
| 2014/0266941 | A1 | 9/2014 | Vazquez et al. | |
| 2015/0249916 | A1 | 9/2015 | Schkub et al. | |
| 2015/0365946 | A1 | 12/2015 | Luong | |
| 2016/0164169 | A1* | 6/2016 | Krogerus | H01Q 21/28 343/702 |
| 2016/0211570 | A1 | 7/2016 | Jin et al. | |
| 2016/0218416 | A1* | 7/2016 | Van Wonterghem | H01Q 21/28 |
| 2016/0124667 | A1 | 10/2016 | Jin et al. | |
| 2016/0322699 | A1 | 11/2016 | Mow et al. | |
| 2016/0351997 | A1* | 12/2016 | Wu | H01Q 1/243 |
| 2017/0048363 | A1 | 2/2017 | Lee et al. | |
| 2017/0104261 | A1* | 4/2017 | Wong | H01Q 1/243 |
| 2017/0170562 | A1* | 6/2017 | Lee | H01Q 1/243 |
| 2017/0201014 | A1* | 7/2017 | Lee | H01Q 1/243 |
| 2018/0026344 | A1* | 1/2018 | Lee | H01Q 1/521 343/702 |

OTHER PUBLICATIONS

Xu Han et al., U.S. Appl. No. 15/429,597, filed Feb. 10, 2017.
Liang Han et al., U.S. Appl. No. 15/602,972, filed May 23, 2017.
Liang Han et al., U.S. Appl. No. 15/255,770, filed Sep. 2, 2016.

* cited by examiner

ADJUSTABLE MULTIPLE-INPUT AND MULTIPLE-OUTPUT ANTENNA STRUCTURES

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, antennas are bulky. In other devices, antennas are compact, but are sensitive to the position of the antennas relative to external objects. If care is not taken, antennas may become detuned, may emit wireless signals with a power that is more or less than desired, or may otherwise not perform as expected.

In addition, it is often difficult to perform wireless communications with a satisfactory data rate (data throughput) using a single antenna in a wireless device, especially as software applications performed by wireless devices become increasingly data hungry. In order to increase the possible data rate for the wireless device, wireless devices can include multiple antennas that convey radio-frequency signals at the same frequency. However, it can be difficult to electromagnetically isolate multiple antennas operating at the same frequency, potentially leading to interference between the radio-frequency signals conveyed by each of the antennas and deterioration in the radio-frequency performance of the wireless device.

It would therefore be desirable to be able to provide improved wireless circuitry for electronic devices such as electronic devices that include multiple antennas.

SUMMARY

An electronic device may be provided with wireless circuitry and control circuitry. The wireless circuitry may include multiple antennas and transceiver circuitry. The antennas may include antenna structures at opposing first and second ends of the electronic device. The antenna structures at a given end of the device may include adjustable components that are adjusted by the control circuitry to place the antenna structures and the electronic device in one of a number of different operating modes or states.

The electronic device may include an antenna ground and a housing having peripheral conductive structures. First and second gaps in the peripheral conductive structures may define a segment that forms an antenna resonating element arm for a first antenna. First, second, third, and fourth antenna feeds may be coupled between different locations along the segment and the antenna ground. Adjustable components may be coupled to the segment. The control circuitry may control the adjustable components to place the electronic device in first or second operating modes. In the first and second operating modes, second and third antennas are formed. The second and third antennas have resonating element arms formed from respective portions of the resonating element arm of the first antenna. The first and fourth antenna feeds may be active (enabled) and the second and third antenna feeds may be inactive (disabled). The transceiver circuitry may concurrently convey radio-frequency signals at the same frequencies over the first and fourth antenna feeds (e.g., over the second and third antennas) using a multiple-input and multiple-output (MIMO) scheme. In the first operating mode, the second and third antennas may cover lower frequencies than in the second operating mode.

The control circuitry may control the adjustable components to place the electronic device in a selected one of third or fourth operating modes. In the third operating mode, the second antenna feed is active and the first, third, and fourth antenna feeds are inactive. In the fourth operating mode, the third antenna feed is active and the first, second, and fourth antenna feeds are inactive. The first antenna may convey radio-frequency signals over the active one of the second and third feeds at lower frequencies than are covered by the second and third antennas in the first and second operating modes. The control circuitry may place the device in a selected one of the third and fourth operating modes based on sensor data to compensate for any loading of the first antenna by the hand of a user of the electronic device.

In the first and second operating modes, at least first and second short circuit (return) paths may be coupled between the segment of the peripheral conductive structures and the antenna ground. The first and second short circuit paths may be interposed between the first and fourth antenna feeds and may serve to isolate the second and third antennas, despite the second and third antennas operating at the same frequencies (e.g., for performing MIMO communications) and despite the second and third antennas including resonating element arms formed from portions of the same peripheral conductive housing structures. If desired, one or more dielectric-filled gaps may be provided in the segment of the peripheral conductive structures to further isolate the second and third antennas in the first and second operating modes.

DETAILED DESCRIPTION

Figure 1:
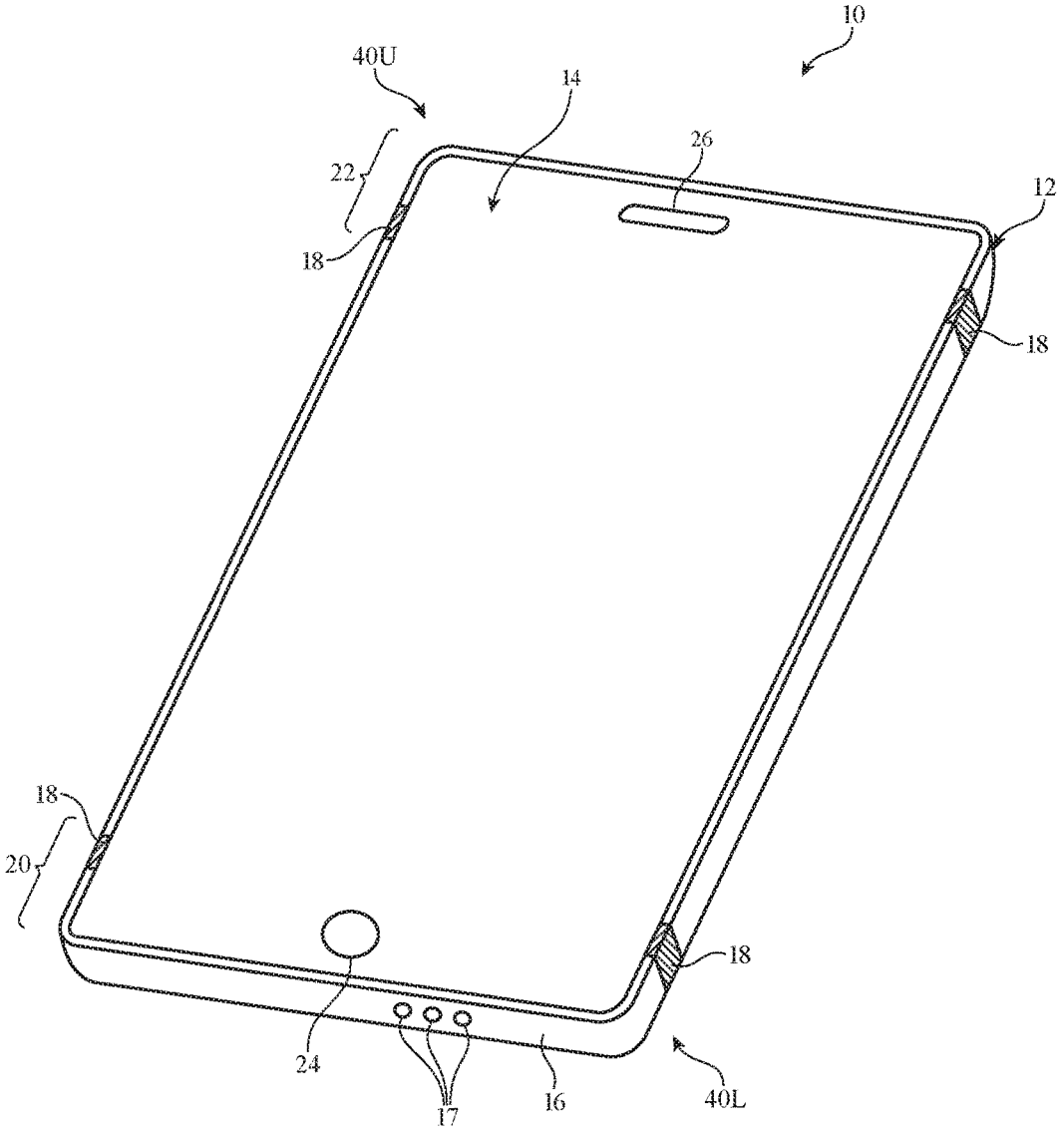
FIG. 1 is a perspective view of an illustrative electronic device with wireless communications circuitry in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, dipole antennas, monopole antennas, helical antennas, patch antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of an electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a portable electronic device such as a laptop computer, a tablet computer, a cellular telephone, a media player, a remote control device, a wearable device such as a wristwatch device, pendant device, headphone or earpiece device, virtual or augmented reality headset device, device embedded in eyeglasses or other equipment worn on a user's head, or other wearable or miniature device, gaming controller, computer mouse, keyboard, mousepad, a navigation device, or trackpad or touchpad device, or electronic device 10 may be a larger device such as a television, a computer monitor containing an embedded computer, a computer display that does not contain an embedded computer, a gaming device, an embedded system such as a system in which electronic equipment is mounted in a kiosk, building, vehicle, or automobile, a wireless access point or base station, a desktop computer, equipment that implements the functionality of two or more of these devices, or other electronic equipment. Other configurations may be used for device 10 if desired. The example of FIG. 1 is merely illustrative.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar housing wall. The rear housing wall may be have slots that pass entirely through the rear housing wall and that therefore separate housing wall portions (and/or sidewall portions) of housing 12 from each other. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer. The cover layer may also have other openings such as an opening for speaker port 26. Speaker port 26 may allow audio signals (sound) to be heard by a user of device 10 (e.g., while the user holds device 10 and speaker port 26 to their ear). Speaker port 26 may therefore sometimes be referred to herein as ear speaker port 26 or ear speaker 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16. If desired, holes such as holes 17 may be provided in peripheral structures 16 or in a rear surface of housing 12. Speakers within device 10 may transmit sound to the exterior of device 10 through holes 17 and/or through ear speaker 26. If desired, microphones may be placed adjacent to holes 17 or any other desired locations within device 10 on to generate audio signals from sound received by device 10.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions.

Housing 12 may include internal conductive structures such as metal frame members and a planar conductive housing member (sometimes referred to as a midplate) that spans the walls of housing 12 (i.e., a substantially rectangular sheet formed from one or more parts that is welded or otherwise connected between opposing sides of member 16). Device 10 may also include conductive structures such as printed circuit boards, components mounted on printed circuit boards, and other internal conductive structures. These conductive structures, which may be used in forming a ground plane in device 10, may be located in the center of housing 12.

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics and may be used in forming slot antenna resonating elements for one or more antennas in device 10.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22.

In general, device 10 may include any suitable number of antennas (e.g., one or more, two or more, three or more, four or more, etc.). In the example of FIG. 1, device 10 includes a first antenna 40L and a second antenna 40U formed on opposing sides of device 10. For example, antenna 40L may be formed within region 20 at the lower end of device 10 (e.g., the end of device 10 adjacent to microphone holes 17) and may therefore sometimes be referred to herein as lower antenna 40L. Similarly, antenna 40U may be formed within region 22 at the upper end of device 10 (e.g., the end of device 10 adjacent to ear speaker 26) and may therefore sometimes be referred to herein as upper antenna 40U. Antennas 40L and 40U may, if desired, be used separately to cover identical communications bands, overlapping communications bands, or separate communications bands. The antennas may be used to implement an antenna diversity scheme or a multiple-input-multiple-output (MIMO) antenna scheme. In the MIMO antenna scheme, antennas 40L and 40U concurrently (e.g., simultaneously) convey radio-frequency signals at one or more of the same frequencies.

The arrangement of FIG. 1 is merely illustrative. In general, the antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. Additional antennas may be formed in regions 22 and/or 20. Antennas in regions 22 may have the same architecture or architecture that is mirrored with respect to antennas in regions 20 or antennas in regions 22 may have different architecture than antennas in region 20. If desired, structures that are used in forming other antennas in region 22 may also be used to form antenna 40U. Similarly, structures that are used in forming other antennas in region 20 may also be used to form antenna 40L.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four gaps 18, etc.).

The segments of peripheral conductive housing structures 16 that are formed in this way may form parts of antennas in device 10. For example, the segment of peripheral conductive housing structures 16 that is located between the two gaps 18 in region 20 may form some or all of an antenna resonating element for lower antenna 40L or for other antennas in region 20 (e.g., one or more resonating element arms of an inverted-F antenna resonating element in scenarios where lower antenna 40L is an inverted-F antenna, a portion of a loop antenna resonating element in scenarios where lower antenna 40L is a loop antenna, a conductive portion that defines an edge of a slot antenna resonating element in scenarios where lower antenna 40L is a slot antenna, combinations of these, or any other desired antenna resonating element structures). Similarly, the segment of peripheral conductive housing structures 16 that is located between the two gaps 18 in region 22 may form some or all of an antenna resonating element for upper antenna 40U or other antennas in region 22. This example is merely illustrative. If desired, antennas 40L and 40U may not include any portion of peripheral conductive housing structures 16 or segments of structures 16 may form part of an antenna ground plane for antennas 40L, 40U, and/or other antennas in device 10.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
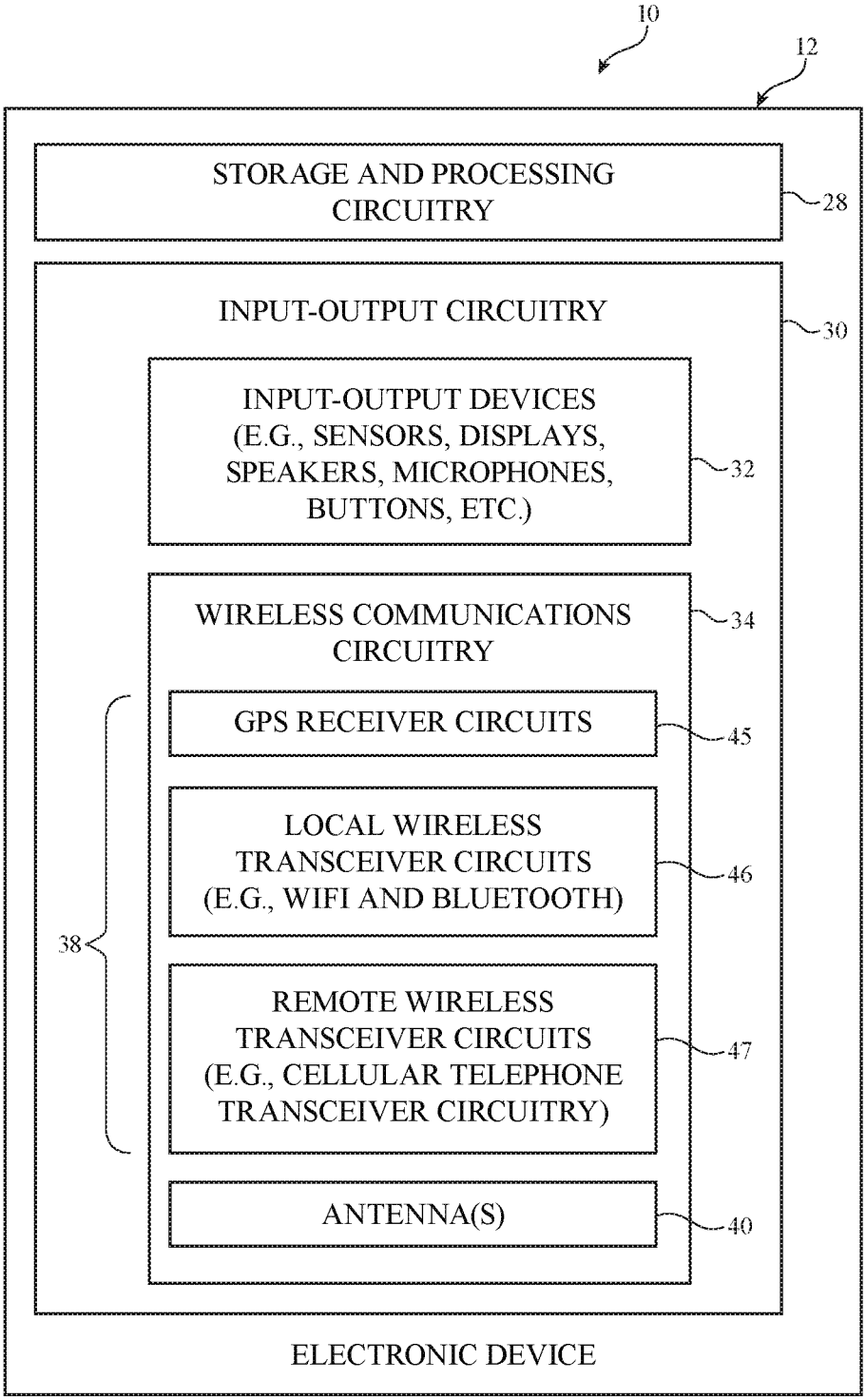
FIG. 2 is a schematic diagram of an illustrative electronic device with wireless communications circuitry in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols (e.g., Long-Term Evolution (LTE) protocols, LTE Advanced protocols, Global System for Mobile Communications (GSM) protocols, Universal Mobile Telecommunications System (UMTS) protocols, or other mobile telephone protocols), multiple-input and multiple-output (MIMO) protocols, antenna diversity protocols, combinations of these, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, sensors such as light sensors, motion sensors (accelerometers), capacitance sensors, proximity sensors, antenna impedance sensors, fingerprint sensors (e.g., a fingerprint sensor integrated with a button such as button 24 of FIG. 1 or a fingerprint sensor that takes the place of button 24), or other sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 38 for handling various radio-frequency communications bands. For example, circuitry 34 may include transceiver circuitry 45, 46, and 47. Transceiver circuitry 46 may handle 2.4 GHz and 5 GHz bands for WiFi® (IEEE 802.11) communications or other wireless local area network (WLAN) bands and may handle the 2.4 GHz Bluetooth® communications band or other wireless personal area network (WPAN) bands. Circuitry 34 may use cellular telephone transceiver circuitry 47 for handling wireless communications in frequency ranges such as a low communications band from 600 to 960 MHz, a low midband from 1400-1520 MHz, a midband from 1710 to 2170 MHz, and a high band from 2300 to 2700 MHz or other communications bands between 600 MHz and 4000 MHz or other suitable frequencies (as examples). Circuitry 47 may handle voice data and non-voice data using one or more cellular telephone protocols (e.g., Long-Term Evolution (LTE) protocols, LTE Advanced protocols, Global System for Mobile Communications (GSM) protocols, Universal Mobile Telecommunications System (UMTS) protocols, other mobile telephone protocols, etc.).

Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 45 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, monopole antenna structures, dipole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Antenna diversity schemes may be implemented in which multiple redundant antennas are used in handling communications for a particular band or bands. In an antenna diversity scheme, storage and processing circuitry 28 may select which antenna to use in real time based on signal strength measurements or other data. In another suitable arrangement, multiple antennas 40 may perform communications using multiple-input-multiple-output (MIMO) schemes. In MIMO schemes, multiple antennas 40 may be used to transmit and/or receive multiple data streams at one or more of the same frequencies, thereby enhancing data throughput.

Figure 3:
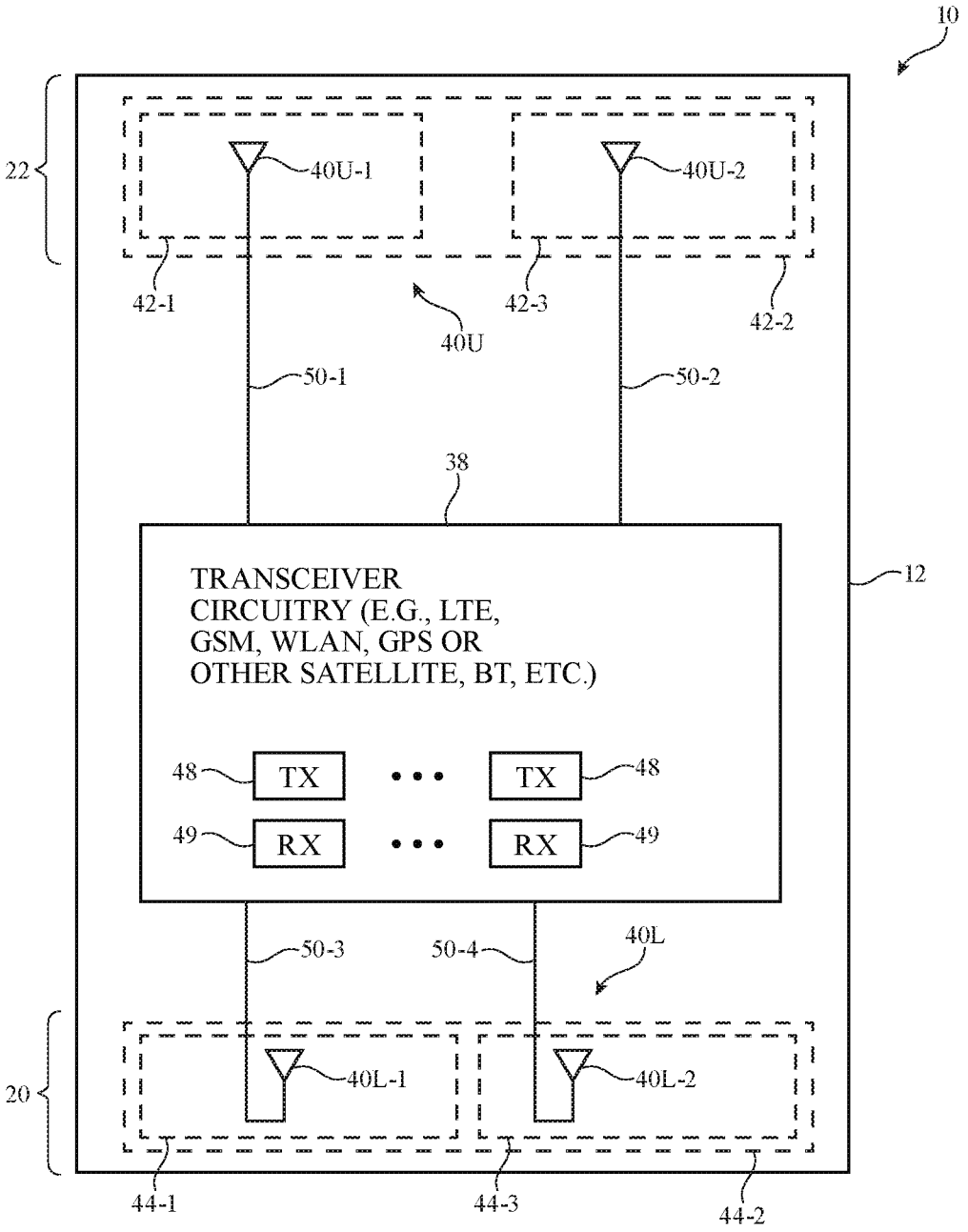
FIG. 3 is a diagram showing how radio-frequency transceiver circuitry may be coupled to one or more antennas within an electronic device in accordance with an embodiment.

Illustrative locations in which multiple antennas 40 may be formed in device 10 are shown in FIG. 3. As shown in FIG. 3, multiple antennas 40 may be mounted within housing 12 and may, if desired, be formed using parts of housing 12 (e.g., parts of peripheral conductive housing structures 16 of FIG. 1). Multiple antennas 40 may be coupled to transceiver circuitry 38 by paths such as paths 50. Paths 50 may include transmission line structures such as coaxial cables, microstrip transmission lines, stripline transmission lines, etc.

Transceiver circuitry 38 may include one or more dedicated transmitters 48, one or more dedicated receivers 49, or one or more transceiver circuits that perform both transmission and reception. Transmitters 48, receivers 49, and transceiver circuits that perform both transmission and reception in circuitry 38 may handle satellite navigation signals (e.g., as a part of circuits 45 of FIG. 2), wireless local area network signals (e.g., as a part of circuits 46 of FIG. 2), voice and/or non-voice cellular telephone signals (e.g., as a part of circuits 47 of FIG. 2), or other signals (e.g., circuits 47, 46, and 45 of FIG. 2 may include one or more dedicated transmitters 48, dedicated receivers 49, or transceivers that perform both transmission and reception). Each dedicated receiver 49, transmitter 48, and transceiver in circuitry 38 may be formed on the same integrated circuit, module, printed circuit, package, or substrate within device 10 or two or more of receivers 49, transmitters 48, and transceivers in circuitry 38 may be formed on separate integrated circuits, modules, packages, printed circuits, or substrates within device 10. If desired, amplifiers, filter circuitry, radio-frequency coupler circuitry, switching circuitry, analog-to-digital converter circuitry, digital-to-analog converter circuitry, mixer circuitry, or other circuitry may be formed as a part of transceiver circuitry 38 or interposed on paths 50.

In a device such as a cellular telephone that has an elongated rectangular outline, it may be desirable to place antennas 40 at one or both ends of the device. As shown in FIG. 3, for example, some of antennas 40 may be placed in upper end region 22 of housing 12 and some of antennas 40 may be placed in lower end region 20 of housing 12.

Antenna structures 40 may be formed within some or all of regions such as regions 22 and 20. For example, an antenna such as antenna 40U-1 may be located within region 42-1 and/or an antenna such as antenna 40U-2 may be located within region 42-3. Each antenna 40U-1 and 40U-2 may be coupled to transceiver circuitry 38 by a corresponding transmission line 50 (e.g., antenna 40U-1 may be coupled to a first port of transceiver circuitry 38 by transmission line 50-1 whereas antenna 40U-2 is coupled to a second port of transceiver circuitry 38 by transmission line 50-2).

If desired, switching circuitry may be coupled between antennas 40U-1 and 40U-2. Control circuitry 28 may control the switching circuitry to configure antennas 40U-1 and 40U-2 to form a single larger antenna 40U that occupies some or all of region 42-2. Antenna 40U may include antenna structures from both antennas 40U-1 and 40U-2. Antenna 40U may be fed using a selected one of transmission lines 50-1 and 50-2 or using other transmission lines (not shown) coupled to transceiver circuitry 38. Control circuitry 28 may control the switching circuitry to configure components in region 22 to form to separate antennas 40U-1 and 40U-2 or to form a single antenna 40U based on device operating conditions, wireless communications requirements, sensor data, or other information (e.g., to optimize wireless performance for device 10).

Similarly, an antenna such as antenna 40L-1 may be located within region 44-1 and/or an antenna such as antenna 40L-2 may be located within region 44-3. Each antenna 40L-1 and 40L-2 may be coupled to transceiver circuitry 38 by a corresponding transmission line 50 (e.g., antenna 40L-1 may be coupled to a first port of transceiver circuitry 38 by transmission line 50-3 whereas antenna 40L-4 is coupled to a second port of transceiver circuitry 38 by transmission line 50-4).

If desired, switching circuitry may be coupled between antennas 40L-1 and 40L-2. Control circuitry 28 may control the switching circuitry to configure antennas 40L-1 and 40L-2 to form a single larger antenna 40L that occupies some or all of region 44-2. Antenna 40L may include antenna structures from both antennas 40L-1 and 40L-2. Antenna 40L may be fed using a selected one of transmission lines 50-3 and 50-4 or using other transmission lines (not shown) coupled to transceiver circuitry 38. Control circuitry 28 may control the switching circuitry to configure components in region 20 to form to separate antennas 40L-1 and 40L-2 or to form a single antenna 40L based on device operating conditions, wireless communications requirements, sensor data, or other information (e.g., to optimize wireless performance for device 10).

Antennas 40U and 40L may occupy a larger space (e.g., a larger area or volume within device 10) than antennas 40U-1, 40U-2, 40L-1, or 40L-2. This may allow antennas 40U and 40L to support communications at longer wavelengths (i.e., lower frequencies) than antennas 40U-1, 40U-2, 40L-1, or 40L-2 if desired. In one suitable arrangement, control circuitry 28 may control switching circuitry in regions 22 and 20 to form antennas 40U and 40L when it is desired to convey radio-frequency signals at frequencies that are lower than can otherwise be handled by antennas 40U-1, 40U-2, 40L-1, or 40L-2.

When operating using a single antenna 40, a single stream of wireless data may be conveyed between device 10 and external communications equipment (e.g., one or more other wireless devices such as wireless base stations, access points, cellular telephones, computers, etc.). This may impose an upper limit on the data rate (data throughput) obtainable by wireless communications circuitry 34 in communicating with the external communications equipment. As software applications and other device operations increase in complexity over time, the amount of data that needs to be conveyed between device 10 and the external communications equipment typically increases, such that a single antenna 40 may not be capable of providing sufficient data throughput for handling the desired device operations.

In order to increase the overall data throughput of wireless circuitry 34, multiple antennas 40 such as antennas 40U-1, 40U-2, 40U, 40L, 40L-1, and/or 40L-2 may be operated using multiple-input and multiple-output (MIMO) schemes. When operating using a MIMO scheme, two or more antennas 40 on device 10 may be used to convey multiple independent streams of wireless data at the same frequencies. This may significantly increase the overall data throughput between device 10 and the external communications equipment relative to scenarios where only a single antenna 40 is used. In general, the greater the number of antennas 40 that are used for conveying wireless data under the MIMO scheme, the greater the overall throughput of circuitry 34.

However, if care is not taken, radio-frequency signals conveyed in the same frequency band by multiple antennas 40 may interfere with each other, serving to deteriorate the overall wireless performance of circuitry 34. Ensuring that antennas operating at the same frequency are electromagnetically isolated from each other can be particularly challenging for adjacent antennas 40 (e.g., antennas 40U-1 and 40U-2, antennas 40L-1 and 40L-2, etc.) and for antennas 40 that have common (shared) structures (e.g., that have resonating elements formed from adjacent or shared conductive portions of housing 12).

In order to perform wireless communications under a MIMO scheme, antennas 40 need to convey data at the same frequencies. If desired, wireless circuitry 34 may perform so-called two-stream (2×) MIMO operations (sometimes referred to herein as 2×MIMO communications or communications using a 2×MIMO scheme) in which two antennas 40 are used to convey two independent streams of radio-frequency signals at the same frequency. Wireless circuitry 34 may perform so-called four-stream (4×) MIMO operations (sometimes referred to herein as 4×MIMO communications or communications using a 4×MIMO scheme) in which four antennas 40 are used to convey four independent streams of radio-frequency signals at the same frequency. Performing 4×MIMO operations may support higher overall data throughput than 2×MIMO operations because 4×MIMO operations involve four independent wireless data streams whereas 2×MIMO operations involve only two independent wireless data streams. If desired, pairs of antennas 40U-1, 40U-2, 40L-1, and 40L-2 may perform 2×MIMO operations in one or more frequency bands and/or all of antennas 40U-1, 40U-2, 40L-1, and 40L-2 may perform 4×MIMO operations in one or more frequency bands (e.g., depending on which bands are handled by which antennas). If desired, antennas 40U-1, 40U-2, 40L-1, and 40L-2 may perform 2×MIMO operations in some bands concurrently with performing 4×MIMO operations in other bands, for example. When antennas 40U-1 and 40U-2 are configured to form upper antenna 40U and antennas 40L-1 and 40L-2 are configured to form lower antenna 40L, wireless circuitry 34 may perform 2×MIMO operations using antennas 40U and 40L at one or more frequencies, for example. Antennas 40U and 40L need not perform communications using a MIMO scheme if desired.

Figure 4:
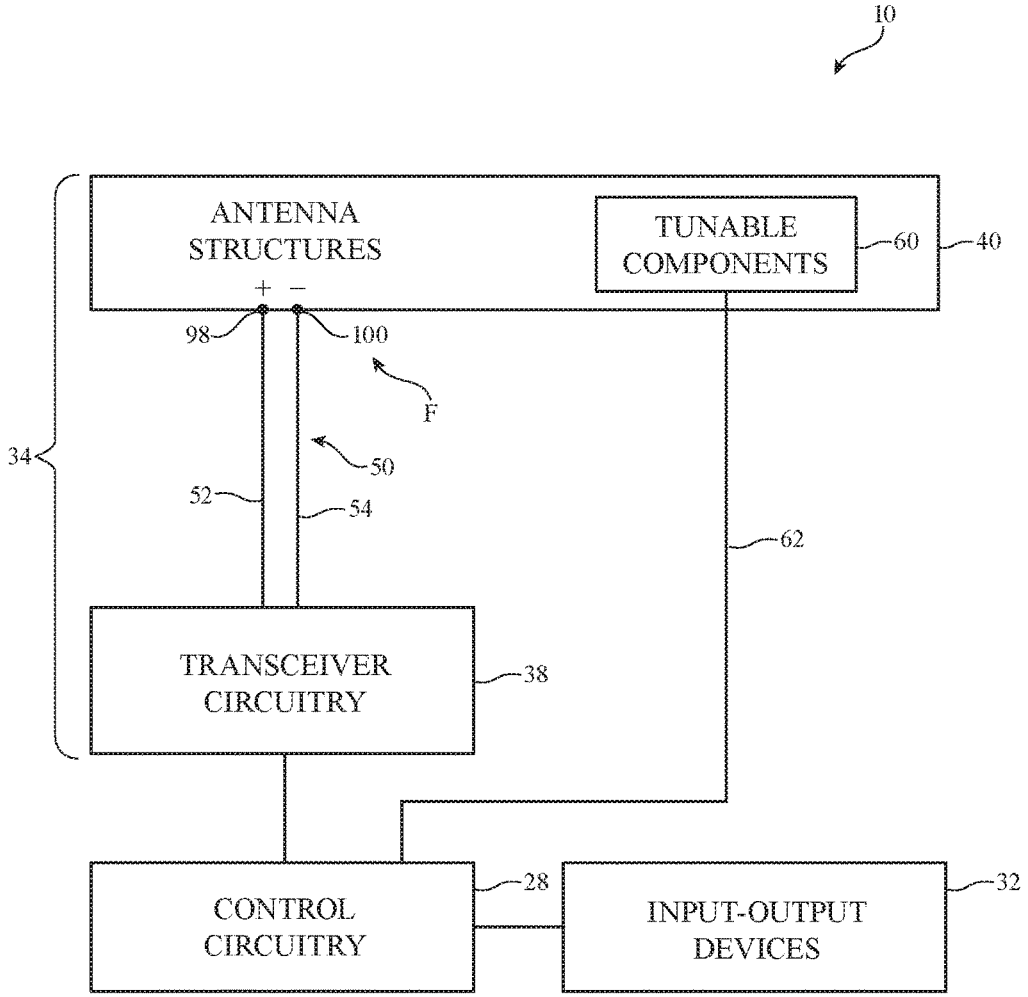
FIG. 4 is a diagram of illustrative wireless communications circuitry in accordance with an embodiment.

FIG. 4 is a diagram showing how transceiver circuitry 38 may be coupled to each antenna 40 using a corresponding transmission path 50. As shown in FIG. 4, transceiver circuitry 38 in wireless circuitry 34 may be coupled to antenna structures 40 (e.g., a given one of antennas 40U-1, 40U-2, 40U, 40L-1, 40L-2, or 40L as shown in FIG. 3) using paths such as path 50 (e.g., a corresponding one of paths 50-1, 50-2, 50-3, 50-4, or other transmission line paths 50). Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna).

If desired, antenna(s) 40 may be provided with adjustable circuits such as tunable components 60. Tunable components 60 may place antenna structures 40 in one of a number of possible operating modes and/or may tune antenna structures 40 over communications bands of interest. Tunable components 60 may be part of a tunable filter or tunable impedance matching network, may be part of an antenna resonating element, may span a gap between an antenna resonating element and antenna ground, etc. Tunable components 60 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 62 that adjust inductance values, capacitance values, or other parameters associated with tunable components 60, thereby tuning antenna structures 40 to cover desired communications bands. If desired, components 60 may include fixed (non-adjustable) tuning components such as capacitors, resistors, and/or inductors.

Path 50 may include one or more transmission lines. As an example, signal path 50 of FIG. 2 may be a transmission line having a positive signal conductor such as line 52 and a ground signal conductor such as line 54. Lines 52 and 54 may form parts of a coaxial cable, a stripline transmission line, or a microstrip transmission line (as examples). A matching network formed from components such as fixed or tunable inductors, resistors, and capacitors may be used in matching the impedance of antenna(s) 40 to the impedance of transmission line 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components (e.g., components 60).

Transmission line 50 may be coupled to antenna feed structures such as antenna feed F associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 52 may be coupled to positive antenna feed terminal 98 and ground transmission line conductor 54 may be coupled to ground antenna feed terminal 100. Other types of antenna feed arrangements may be used if desired. For example, antenna structures 40 may be fed using multiple feeds. The illustrative feeding configuration of FIG. 4 is merely illustrative.

Antenna structures 40 may include resonating element structures, antenna ground plane structures, an antenna feed such as feed F, and other components (e.g., tunable components 60). Antenna structures 40 may be configured to form any suitable types of antenna. With one suitable arrangement, which is sometimes described herein as an example, antenna structures 40 are used to implement a hybrid inverted-F-slot antenna that includes both inverted-F and slot antenna resonating elements.

If desired, tunable components 60 may include switching circuitry that is controlled by control circuitry 28 to configure antenna structures in region 22 to form two separate antennas 40U-1 and 40U-2 or a single antenna 40U (or to configure antenna structures in region 20 to form two separate antennas 40L-1 and 40L-2 or a single antenna 40L). Switching circuits in tunable components 60 may, if desired, couple antenna structures 40 to one or more selected transmission line paths 50.

Figure 5:
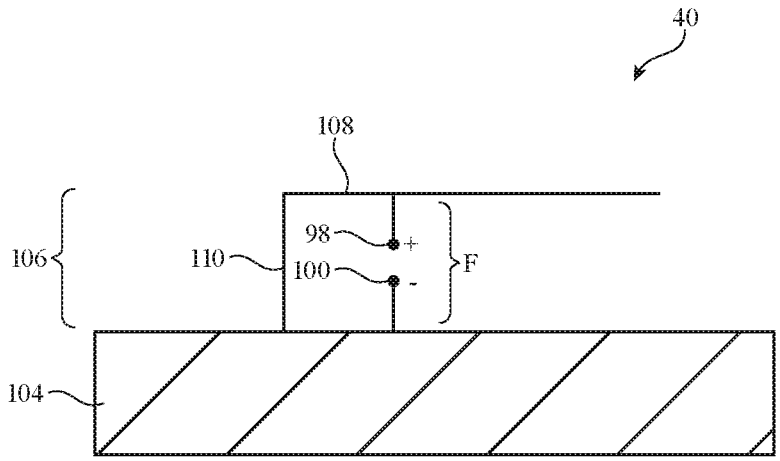
FIG. 5 is a schematic diagram of an illustrative inverted-F antenna in accordance with an embodiment.

Antennas 40 in device 10 may be formed using any desired antenna type. For example, an antenna 40 may include an antenna with a resonating element that is formed from loop antenna structures, patch antenna structures, inverted-F antenna structures, slot antenna structures, planar inverted-F antenna structures, helical antenna structures, monopole antenna structures, dipole antenna structures, hybrids of these designs, etc. FIG. 5 is a diagram of illustrative inverted-F antenna structures that may be used in implementing an antenna 40 for device 10.

As shown in FIG. 5, antenna 40 may include inverted-F antenna resonating element 106 and antenna ground (ground plane) 104. Antenna resonating element 106 may have a main resonating element arm such as arm 108. The length of arm 108 and/or portions of arm 108 may be selected so that antenna 40 resonates at desired operating frequencies. For example, the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. An inductor or other component may be interposed in path 110 and/or tunable components 60 (FIG. 4) may be interposed in path 110. If desired, tunable components 60 may be coupled in parallel with path 110 between arm 108 and ground 104. Additional return paths 110 may be coupled between arm 108 and ground 104 if desired.

Antenna 40 may be fed using one or more antenna feeds. For example, antenna 40 may be fed using antenna feed F. Antenna feed F may include positive antenna feed terminal 98 and ground antenna feed terminal 100 and may run in parallel to return path 110 between arm 108 and ground 104. If desired, inverted-F antennas such as illustrative antenna 40 of FIG. 5 may have more than one resonating arm branch (e.g., to create multiple frequency resonances to support operations in multiple communications bands) or may have other antenna structures (e.g., parasitic antenna resonating elements, tunable components to support antenna tuning, etc.). For example, arm 108 may have left and right branches that extend outwardly from feed F and return path 110. Multiple feeds may be used to feed antennas such as antenna 40.

Figure 6:
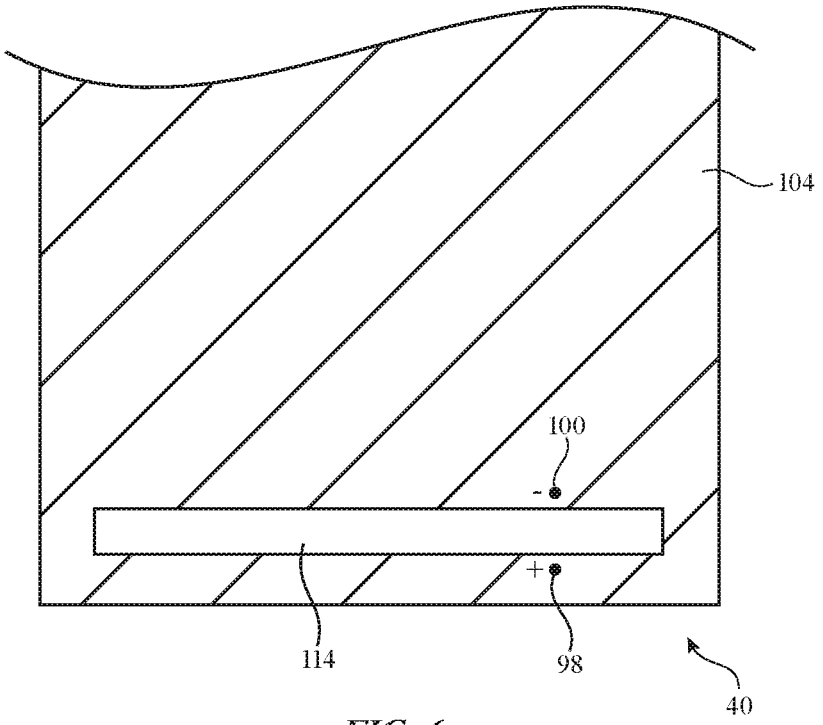
FIG. 6 is a schematic diagram of an illustrative slot antenna in accordance with an embodiment.

Antenna 40 may be a hybrid antenna that includes one or more slot antenna resonating elements. As shown in FIG. 6, for example, antenna 40 may be based on a slot antenna configuration having an opening such as slot 114 that is formed within conductive structures such as antenna ground 104. Slot 114 (sometimes referred to herein as opening 114) may be filled with air, plastic, and/or other dielectric. The shape of slot 114 may be straight or may have one or more bends (i.e., slot 114 may have an elongated shape following a meandering path). Feed terminals 98 and 100 may, for example, be located on opposing sides of slot 114 (e.g., on opposing long sides). Slot-based antenna resonating elements such as slot antenna resonating element 114 of FIG. 6 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength.

Slot antenna frequency response can be tuned using one or more tuning components (e.g., components 60 of FIG. 4). These components may have terminals that are coupled to opposing sides of the slot (i.e., the tunable components may bridge the slot). If desired, tunable components may have terminals that are coupled to respective locations along the length of one of the sides of slot 114. Combinations of these arrangements may also be used. If desired, antenna 40 may be a hybrid slot-inverted-F antenna that includes resonating elements of the type shown in both FIG. 5 and FIG. 6 (e.g., having resonances given by both a resonating element arm such as arm 108 of FIG. 5 and a slot such as slot 114 of FIG. 6).

Figure 7:
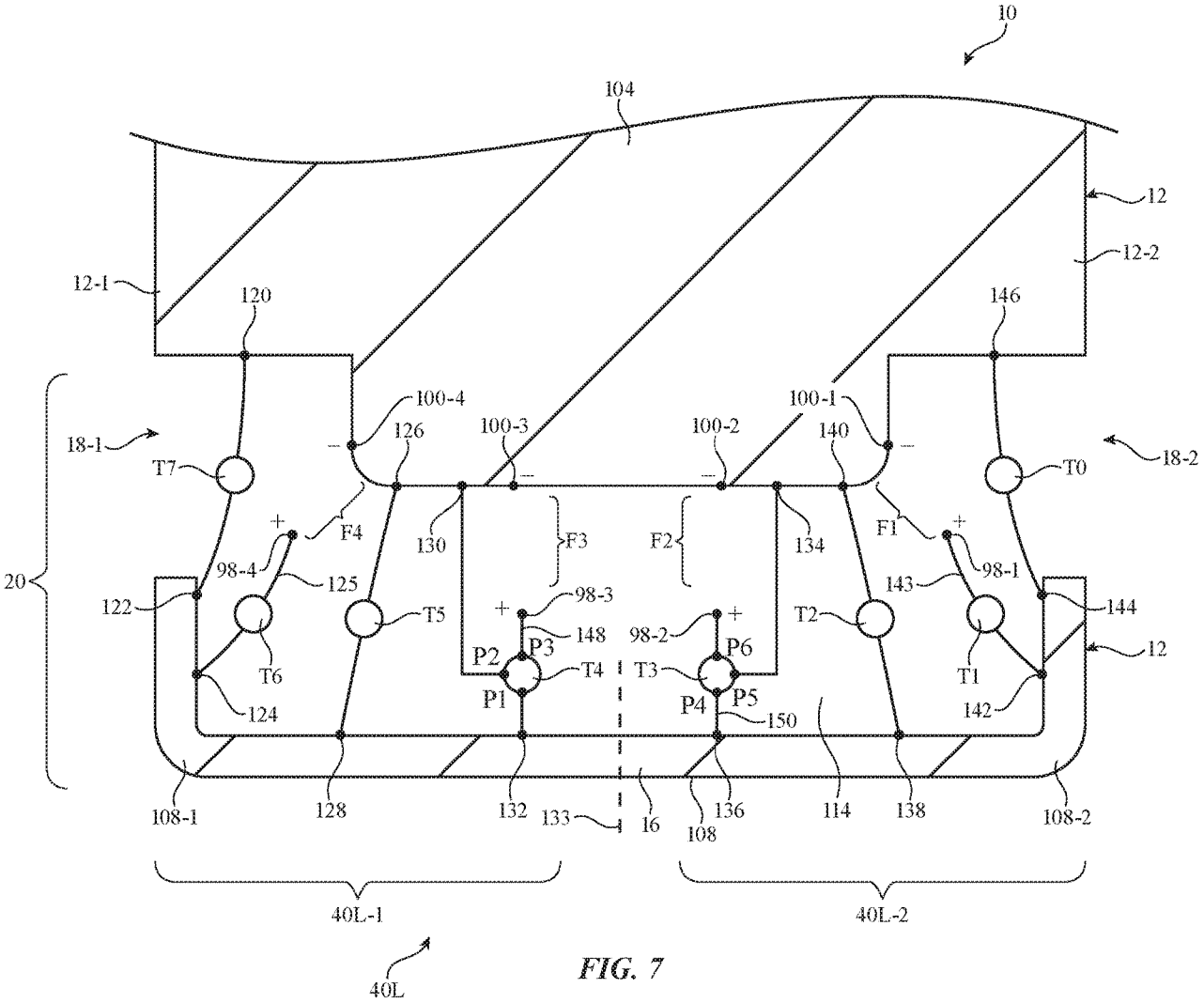
FIG. 7 is a diagram of illustrative antenna structures that are switchable between multiple operating modes in accordance with an embodiment.

An illustrative configuration for an antenna with slot and inverted-F antenna structures such as antenna 40L of FIG. 3 is shown in FIG. 7. The presence or absence of external objects such as a user's hand or other body part in the vicinity of antenna 40L may affect antenna loading and therefore antenna performance. Antenna loading may differ depending on the way in which device 10 is being held. For example, antenna loading and therefore antenna performance may be affected in one way when a user is holding device 10 in the user's right hand and may be affected in another way when a user is holding device 10 in the user's left hand.

As shown FIG. 7, adjustable components 60 (FIG. 4) in antenna 40L may include adjustable components such as components T0, T1, T2, T3, T4, T5, T6, and T7. To accommodate various loading scenarios, device 10 may use sensor data, antenna measurements, information about the usage scenario or operating state of device 10, and/or other data from input-output circuitry 30 to monitor for the presence of antenna loading (e.g., the presence of a user's hand, the user's head, or another external object). Device 10 (e.g., control circuitry 28) may then adjust components T0, T1, T2, T3, T4, T5, T6, and T7 to compensate for the loading.

In order to further help compensate for antenna loading due to the presence of external objects such as the user's hand at different locations relative to device 10, antenna 40L may include multiple antenna feeds (e.g., antenna feeds such as antenna feed F of FIG. 4). Control circuitry 28 may selectively activate one of the multiple antenna feeds at a given time. For example, control circuitry 28 may selectively activate the antenna feed that is located farthest away from an external object that is loading the antenna to help minimize the impact of the presence of the external object on the performance of antenna 40.

As shown in FIG. 7, antenna 40L (e.g., a hybrid slot-inverted-F antenna) may include multiple feeds F such as a first feed F1, a second feed F2, a third feed F4, and a fourth feed F5 coupled between resonating element arm 108 and ground 104 across slot 114. Feeds F1, F2, F3, and F4 may be coupled to one or more transceivers in transceiver circuitry 38 via corresponding transmission lines 50 (FIGS. 3 and 4).

Resonating element arm 108 of antenna 40L may be formed from a portion of housing 12 such as a segment of peripheral conductive structures 16 that extends between gaps 18-1 and 18-2 (e.g., gaps 18 in peripheral conductive structures 13 as shown in FIG. 1). Slot 114 may be formed from an elongated gap between peripheral conductive structures 16 and ground 104 (e.g., a slot formed in housing 12 using machining tools or other equipment). For example, a first end of the segment of peripheral structures 16 that forms resonating element arm 108 may define an edge of gap 18-1 whereas an opposing second end of the segment of peripheral structures 16 defines an edge of gap 18-2. The slot may be filled with dielectrics such as air and/or plastic. For example, plastic may be inserted into portions of slot 114 and this plastic may be flush with the outside of housing 12. Portions of slot 114 may contribute slot antenna resonances to antenna 40L.

Antenna feeds F1, F2, F3, and F4 may include respective positive antenna feed terminals 98 and ground antenna feed terminals 100. For example, first antenna feed F1 may include a positive antenna feed terminal 98-1 and a corresponding ground antenna feed terminal 100-1 that are coupled to opposing sides of slot 114. Positive antenna feed terminal 98-1 may be coupled to peripheral conductive structures 16 via feed leg 143 whereas ground antenna feed terminal 100-1 is coupled to ground plane 104.

Similarly, second antenna feed F2 may include a positive antenna feed terminal 98-2 and a corresponding ground antenna feed terminal 100-2 that are coupled to opposing sides of slot 114. Positive antenna feed terminal 98-2 may be coupled to peripheral conductive structures 16 via feed leg 150 whereas ground antenna feed terminal 100-2 is coupled to ground plane 104. Third antenna feed F3 may include a positive antenna feed terminal 98-3 and a corresponding ground antenna feed terminal 100-3 that are coupled to opposing sides of slot 114. Positive antenna feed terminal 98-3 may be coupled to peripheral conductive structures 16 via feed leg 148 whereas ground antenna feed terminal 100-3 is coupled to ground plane 104. Fourth antenna feed F4 may include a positive antenna feed terminal 98-4 and a corresponding ground antenna feed terminal 100-4 that are coupled to opposing sides of slot 114. Positive antenna feed terminal 98-4 may be coupled to peripheral conductive structures 16 via feed leg 125 whereas ground antenna feed terminal 100-4 is coupled to ground plane 104.

Feed F3 may be interposed between feeds F4 and F2 and feed F2 may be interposed between feeds F3 and F1. If desired, feeds F1, F2, F3, and F4 may be symmetrically distributed about central longitudinal axis 133 of device 10 (e.g., a central axis 133 that bisects device 10 and runs parallel to the longest dimension of device 10). For example, feeds F3 and F2 may be located at approximately the same distance from opposing sides of axis 133 and feeds F1 and F4 may be located at approximately the same distance from opposing sides of axis 133 (e.g., feeds F1 and F2 may be respectively located at the same distances from gap 18-2 as feeds F4 and F3 are from gap 18-1). This example is merely illustrative. In general, antenna feeds F1 and F2 may be located at any desired distances with respect to a first side of axis 133 and antenna feeds F3 and F4 may be located at any desired distances with respect to a second side of axis 133 (e.g., where feed F2 is closer to axis 133 than feed F1 and feed F3 is closer to axis 133 than feed F4).

Feed legs 143, 150, 148, and 125 may sometimes be referred to herein as feed arms, feed paths, feed conductors, or feed elements. Feed legs 143, 150, 148, and 125 may include any desired conductive structures such as conductive wire, metal traces on a rigid or flexible printed circuit board, sheet metal, metal portions of electronic device components, conductive radio-frequency connectors, conductive spring structures, metal screws or other fasteners, weld structures, solder structures, conductive adhesive structures, combinations of these structures, etc. Feed leg 143 may be coupled to peripheral conductive structures 16 at point 142 whereas feed leg 150 is coupled to structures 16 at point 136, feed leg 148 is coupled to structures 16 at point 132, and feed leg 125 is coupled to structures 136 at point 124.

Adjustable components 60 of FIG. 4 may include adjustable components T0, T1, T2, T3, T4, T5, T6, and T7 of FIG. 7. Adjustable component T1 may be interposed on feed leg 143 between feed terminal 98-1 and peripheral structures 16. Adjustable component T3 may be interposed on feed leg 150 between feed terminal 98-2 and peripheral structures 16. Adjustable component T4 may be interposed on feed leg 148 between feed terminal 98-3 and peripheral structures 16. Adjustable component T4 may be interposed on feed leg 125 between feed terminal 98-4 and peripheral structures 16.

Control circuitry 28 may adjust components T1, T3, T4, and T6 to selectively activate one or more of feeds F1, F2, F3, and F4 at a given time and/or to adjust the performance of antenna 40. Component T1 may, for example, include a switch coupled between terminal 98-1 and point 142. Similarly, component T6 may include a switch coupled between terminal 98-4 and point 124. Control circuitry 28 may turn the switch in component T1 to couple feed terminal 98-1 to point 142, thereby activating feed F1, and may turn off the switch in component T2 to decouple feed terminal 98-1 from point 142, thereby deactivating feed F1. Similarly, control circuitry 28 may turn the switch in component T6 to couple feed terminal 98-4 to point 124, thereby activating feed F4, and may turn off the switch in component T6 to decouple feed terminal 98-4 from point 124, thereby deactivating feed F4.

Component T3 may include switching circuitry having a first switch port (terminal) P4 coupled to point 136, a second switch port P5 coupled to point 134 on ground 104, and a third switch port P6 coupled to feed terminal 98-2. The switching circuitry in component T3 may have a first state at which port P6 is coupled to port P4, a second state at which port P4 is coupled to port P5, and a third state at which an open circuit is formed between each of ports P4, P5, and P6. When the switching circuitry in component T3 is in the first state, feed terminal 98-2 may be coupled to point 136 and feed F2 may be active. When the switching circuitry in component T3 is in the second state, a return (short circuit) path is formed between point 136 on structures 16 and point 134 on antenna ground 104, feed terminal 98-2 is decoupled peripheral structures 16, and feed F2 is inactive. When the switching circuitry in component T3 is in the third state, an open circuit is formed between peripheral structures 16 and ground 104 at the location of feed F2 and feed F2 is inactive.

Component T4 may include switching circuitry having a first switch port (terminal) P1 coupled to point 132, a second switch port P2 coupled to point 130 on ground 104, and a third switch port P3 coupled to feed terminal 98-3. The switching circuitry in component T4 may have a first state at which port P1 is coupled to port P3, a second state at which port P1 is coupled to port P2, and a third state at which an open circuit is formed between each of ports P1, P2, and P3. When the switching circuitry in component T4 is in the first state, feed terminal 98-3 may be coupled to point 132 and feed F3 may be active. When the switching circuitry in component T4 is in the second state, a return (short circuit) path is formed between point 132 on structures 16 and point 130 on antenna ground 104, feed terminal 98-3 is decoupled from peripheral structures 16, and feed F3 is inactive. When the switching circuit in component T4 is in the third state, an open circuit is formed between peripheral structures 16 and ground 104 at the location of feed F3 and feed F3 is inactive. By adjusting components T6, T4, T3, and T1, control circuitry 28 may selectively activate one or more of feeds F4, F3, F2, and F1 at a given time.

Adjustable components T0, T2, T5, and T7 may be coupled between ground 104 and peripheral structures 16 across slot 114. For example, a first terminal 146 of adjustable component T0 may be coupled to ground 104 whereas a second terminal 144 of adjustable component T0 is coupled to peripheral structures 16. A first terminal 140 of component T2 may be coupled to ground 104 whereas a second terminal 138 of component T2 is coupled to peripheral structures 16. A first terminal 126 of component T5 may be coupled to ground 104 whereas a second terminal 128 of component T5 is coupled to peripheral structures 16. A first terminal 120 of component T7 may be coupled to ground 104 whereas a second terminal 122 of component T7 is coupled to peripheral structures 16.

In the example of FIG. 7, feed terminal 100-1 is interposed between component terminals 140 and 146, terminal 140 is interposed between terminals 100-1 and 134, terminal 134 is interposed between terminals 100-2 and 140, terminal 100-2 is interposed between terminals 100-3 and 134, terminal 100-3 is interposed between terminals 130 and 100-2, terminal 126 is interposed between terminals 100-4 and 130, and terminal 100-4 is interposed between terminals 120 and 126 on ground plane 104. Similarly, terminal 142 is interposed between terminals 138 and 144, terminal 138 is inter posed between terminals 136 and 138, terminal 136 is interposed between terminals 132 and 138, terminal 132 is interposed between terminals 128 and 136, terminal 128 is interposed between terminals 124 and 123, and terminal 124 is interposed between terminals 122 and 128 on structures 16. This is merely illustrative and, if desired, components T0 through T7 may be arranged in any other desired order.

Adjustable components T0, T2, T5, and T7 may include switchable inductors, resistors, and/or capacitors coupled in series and/or in parallel between ground 104 and peripheral structures 16. Control circuitry 28 may adjust components T0, T2, T5, and/or T7 to adjust the resonant frequency of antenna 40L, to adjust the antenna efficiency of antenna 40L in one or more bands, to change the location of short paths across slot 114, or to perform other antenna adjustments. In one suitable arrangement, component T0 may be identical to component T7 and component T5 may be identical to component T2. In another suitable arrangement, components T0, T2, T5, and T7 may include different circuit components therein.

During operation, components T0, T2, T3, T4, T5, and/or T7 may form return paths for antenna 40L such as path 110 of FIG. 5. For example, return paths may be formed by components T0, T2, T3, T4, T5, and/or T7 when switches in the adjustable components are closed to form a short circuit across slot 114. Using switchable return paths and multiple selectively-activated antenna feeds may provide antenna 40 with flexibility to accommodate different loading conditions (e.g., different loading conditions that may arise due to the presence of a user's hand or other external object on various different portions of device 10 adjacent to various different corresponding portions of antenna 40).

Adjustable components such as components T0-T7 may be used in adjusting the operation of antenna 40L. Components T0-T7 may include switches such as adjustable return path switches, adjustable feed path switches, switches coupled to fixed components such as inductors and/or capacitors and other circuitry for providing adjustable amounts of capacitance, adjustable amounts of inductance, open and closed circuits, etc. Adjustable components in antenna 40L may be used to tune antenna coverage, may be used to restore antenna performance that has been degraded due to the presence of an external object such as a hand or other body part of a user, and/or may be used to adjust for other operating conditions and to ensure satisfactory operation at desired frequencies.

Antenna 40L of FIG. 7 may be used to cover radio-frequency communications in any desired communications bands. In one suitable arrangement that is sometimes described herein by example, antenna 40L may exhibit resonances in a low band LB (e.g., a band from 600 to 960 MHz), a low midband from (e.g., a band from 1400 to 1520 MHz), a midband MB (e.g., a band from 1710 to 2170 MHz), and a high band HB (e.g., a band from 2300 to 2700 MHz). These bands may, for example, be cellular telephone communications bands handled by transceiver circuitry 47 of FIG. 2.

In one suitable arrangement, antenna 40L may convey radio-frequency signals in one or more of these bands when a selected one of feeds F2 and F3 is activated. The resonance of antenna 40L in low band LB may be associated with the distance along peripheral conductive structures 16 between the active one of antenna feeds F2 and F3 and the farther of gaps 18-1 and 18-2 from the active antenna feed, for example. Antenna performance in high band HB may be supported by a resonance of slot 114 between structures 16 and ground 104. If desired, antenna 40L may be provided with a parasitic antenna resonating element that contributes a resonance in high band HB for antenna 40L. The parasitic antenna resonating element may, for example, be formed from conductive structures such as conductive housing structures (e.g., an integral portion of housing such as a portion of housing 12 forming ground 104), from parts of conductive housing structures, from parts of electrical device components, from printed circuit board traces, from strips of conductor (e.g., strips of conductor or elongated portions of ground 104 that are embedded or molded into slot 114), or other conductive materials. The parasitic antenna resonating element may be coupled to antenna resonating element 108 (e.g., peripheral structures 16) by near-field electromagnetic coupling and is used to modify the frequency response of antenna 40L so that antenna 40L operates in high band HB. As one example, the parasitic antenna resonating element may be based on a slot antenna resonating element structure formed using slot 114 (e.g., an open slot structure such as a slot with one open end and one closed end or a closed slot structure such as a slot that is completely surrounded by metal).

The resonance of antenna 40L in low midband LMB and midband MB may be associated with the distance between the active one of antenna feeds F2 and F3 and a return path between peripheral structures 16 and ground 104 formed by one or more components T0, T2, T3, T4, T5, and T7. Control circuitry 28 may tune the resonance of antenna 40 within low midband LMB, midband MB, and/or high band HB by adjusting components T0, T2, T3, T4, T5, and/or T7.

For example, when feed F2 is active, the length of structures 16 between feed F2 and gap 18-1 may be associated with the resonance in low band LB. The length of structures 16 between feed F2 and component T0 may be associated with the resonance in low midband LMB and midband MB. The portion of slot 114 between feed F2 and component T0 or the portion of slot between feed F2 and component T7 may be associated with the resonance in high band HB. Adjustable components T3, T4, T5, and/or T7 may be used to tune the response of antenna 40L in low band LB whereas components T0, T2, T5 and/or T7 may be used to tune the response of antenna 40L in low midband LMB, midband MB, and/or high band HB in this scenario.

When feed F3 is active, the length of structures 16 between feed F3 and gap 18-2 may be associated with the resonance in low band LB. Adjustable components T3, T4, T2, and/or T0 may be used to tune the response of antenna 40L in low band LB whereas components T5, T2, T0, and/or T7 may be used to tune the response of antenna 40L in low midband LMB, midband MB, and/or high band HB in this scenario.

The presence or absence of external objects such as a user's hand or other body part in the vicinity of antenna 40L may affect antenna loading and therefore antenna performance. For example, in the presence of external loading, the efficiency of antenna 40L in one or more of bands LB, LMB, MB, and HB may be degraded relative to when antenna 40L is operated in a free space environment.

In practice, antenna loading may differ depending on the way in which device 10 is being held and depending on which antenna feed is active. In the example of FIG. 7, antenna 40L is shown from the front of device 10 (e.g., through display 14). Edge 12-2 is associated with the right edge of housing 12 when device 10 is viewed from the front and edge 12-1 is associated with the left edge of housing 12 when device 10 is viewed from the front. In this example, when a user is holding device 10 in the user's right hand, the palm of the user's right hand will rest along edge 12-2 of housing 12 and the fingers of the user's right hand (which do not load antenna 40L as much as the user's palm) will rest along edge 12-1 of housing 12. In this situation, if antenna feed F3 is active, loading from the user's right hand may degrade the low band resonance of antenna 40L. Control circuitry 28 may detect the presence of the user's right hand in this scenario and, in response to such a detection, may deactivate antenna feed F3 and instead activate antenna feed F2. Activating antenna feed F2 may shift antenna current hotspots on peripheral structures 16 in the low band away from the right side (e.g., side 12-2) and towards the left side (e.g., side 12-1) of device 10. This shift of current hotspots may reduce the loading and corresponding detuning of antenna 40L in the low band by the user's right hand.

When a user is holding device 10 in the user's left hand, the palm of the user's left hand will rest along the left edge of device 10 (e.g., housing edge 12-1 of FIG. 7) and the fingers of the user's left hand will rest along edge 12-2 of device 10. In this scenario, the palm of the user's hand may load the portion of antenna 40 near to edge 12-1. If antenna feed F2 is active, loading from the user's left hand may degrade the low band resonance of antenna 40L. Control circuitry 28 may detect the presence of the user's left hand in this scenario and, in response to such a detection, may deactivate antenna feed F2 and instead activate antenna feed F3. Activating antenna feed F3 may shift antenna current hotspots on peripheral structures 16 in the low band away from the left side 12-1 and towards right side 12-2 of device 10. This shift of current hotspots may reduce the loading and corresponding detuning of antenna 40L in the low band by the user's left hand. Control circuitry 28 may also adjust components T7, T5, T4, T3, T2, and/or T0 to ensure that antenna 40L remains properly tuned regardless of which antenna feed is active and regardless of which of the user's hand is being used to hold the device.

In some scenarios, antenna 40L may not be capable of providing sufficient data throughput to accommodate all of the processing operations that are being performed by device 10. In these scenarios, control circuitry 28 may adjust components T1 through T7 to form two separate antennas 40L-1 and 40L-2 (FIG. 3) using at least some of the structures of antenna 40L. Antennas 40L-1 and 40L-2 may subsequently convey radio-frequency signals at the same frequency using a MIMO scheme (e.g., a 4×MIMO scheme with antennas 40U-1 and 40U-2 at the opposing end of housing 12). This may, for example, increase the maximum data throughput of circuitry 34 by twice, four times, or more than four times the maximum data throughput of a single antenna 40.

Antenna 40L-1 may be fed using feed F4 whereas antenna 40L-2 is fed using feed F1. Antenna 40L-1 may have a main resonating element arm 108-1 extending from point 132 to gap 18-1. Antenna 40L-2 may have a main resonating element arm 108-2 extending from point 136 to gap 18-2. In order to form antennas 40L-1 and 40L-2, control circuitry 28 may activate feeds F4 and F1 while deactivating feeds F3 and F2. Components T7 and/or T5 may form return paths 110 for antenna 40L-1 whereas components T2 and/or T0 may form return paths 110 for antenna 40L-2. Feed F4 may convey radio-frequency signals (e.g., using a corresponding transmission line such as transmission line 50-3 of FIG. 3) at one or more frequencies for antenna 40L-1. Feed F1 may concurrently convey radio-frequency signals (e.g., using a corresponding transmission line such as transmission line 50-4 of FIG. 3) for antenna 40L-2 at the same frequencies as the signals conveyed by feed F4 (e.g., using a MIMO scheme). This may serve to increase the overall data throughput of wireless circuitry 34 relative to a scenario where only antenna 40L is used to convey radio-frequency signals within region 20 of device 10.

If care is not taken, the radio-frequency signals conveyed by feed F4 may be subject to interference with the radio-frequency signals conveyed by feed F1 (e.g., because the signals are conveyed at the same frequencies). If care is not taken, such interference may reduce the overall antenna efficiency of antennas 40L-1 and 40L-2, introducing errors into the transmitted or received data and/or leading to the corresponding wireless links being dropped.

If desired, control circuitry 28 may control adjustable components T4 and T3 to electromagnetically isolate antennas 40L-1 and 40L-2 (e.g., to mitigate any potential interference between signals conveyed over antennas 40L-1 and 40L-2). For example, control circuitry 28 may control component T4 to short switch port P1 to switch port P2 and may control component T3 to short switch port P4 to switch port P5. This may serve to short any stray antenna currents from antenna 40L-1 to the right of feed F4 from point 132 to point 130 on ground 104. Similarly, antenna currents from antenna 40L-2 to the left of feed F1 may be shorted from point 136 to point 134 on ground 104. This may prevent the antenna currents from antenna 40L-1 from approaching or mixing with the antenna currents from antenna 40L-2, thereby serving to electromagnetically isolate antennas 40L-1 and 40L-2 despite the fact that the resonating element arm for both antennas is formed from the same conductor (i.e., peripheral structure 16) and both antennas convey radio-frequency signals at the same frequencies.

A resonance of slot 114 between arm 108-1 and ground 104 (e.g., a parasitic element within slot 114 between arm 108-1 and ground 104) may support a resonance of antenna 40L-1 in high band HB. A resonance of slot 114 between arm 108-2 and ground 104 (e.g., a parasitic element within slot 114 between arm 108-2 and ground 104) may support a resonance of antenna 40L-2 in high band HB. The length of arm 108-1 between feed F4 and component T5 may support a resonance of antenna 40L-1 in midband MB. A length of arm 108-2 between component feed F1 and component T2 may support a resonance of antenna 40L-2 in midband MB.

If desired, control circuitry 28 may adjust components T5 and T2 to allow antennas 40L-1 and 40L-2 to cover frequencies towards the lower end of midband MB (e.g., towards low midband LMB). For example, in scenarios where coverage in the lower end of midband MB is not necessary, control circuitry 28 may control component T5 to form a short circuit between point 128 and point 126 on ground 104 and may control component T2 to form a short circuit between point 138 and point 140 on ground 104. When configured in this way, antenna currents from feed F4 may be shorted to ground 104 at point 126 and antenna currents from feed F1 may be shorted to ground 104 at point 140.

When cover towards the lower end of midband MB and low midband LMB is desired, control circuitry 28 may control component T5 to form an open circuit between point 128 and point 126 on ground 104 and may control component T2 to form an open circuit between point 138 and point 140 on ground 104. When configured in this way, antenna currents from feed F4 may be shorted to ground 104 at point 130 and antenna currents from feed F1 may be shorted to ground 104 at point 134. In this scenario, the greater length of arm 108-1 from feed F4 to point 132 may support a resonance of antenna 40L-1 at lower frequencies in midband MB and in low midband LMB whereas the length of arm 108-2 from feed F1 to point 136 may support a resonance of antenna 40L-2 at lower frequencies in midband MB and in low midband LMB.

If desired, control circuitry 28 may control adjustable inductor circuitry, adjustable capacitor circuitry, switching circuitry, or other circuitry in components T0 and T7 to tune the resonance of antenna 40L-1 the resonance of antenna 40L-2 in high band HB. In this way, antennas 40L-1 and 40L-2 may support communications at the same frequencies in low midband LMB, midband MB, and/or high band HB for performing MIMO operations at one or more frequencies (e.g., at least one frequency in each of bands LMB, MB, and HB). This may significantly increase the throughput of wireless circuitry relative to scenarios where one of feeds F3 or F4 is active for forming antenna 40L in region 20 of device 10. However, at the same time, antennas 40L-1 and 40L-2 may not have sufficient volume to cover low band LB. If desired, control circuitry 28 may sacrifice the throughput afforded by performing MIMO operations 40L-1 and 40L-2 by configuring adjustable components T0-T7 to form antenna 40L in scenarios where coverage in low band LB is desired. On the other hand, when a relatively high data throughput is required (e.g., for performing data intensive processing operations), control circuitry 28 may sacrifice coverage in low band LB in exchange for the higher data rates of a MIMO scheme by configuring adjustable components T0-T7 to form antennas 40L-1 and 40L-2.

The example of FIG. 7 is merely illustrative. If desired, the diagram of FIG. 7 may illustrate device antenna 40L from the rear of device 10. In this scenario, edge 12-2 is associated with the left edge of housing 12, edge 12-1 is associated with the right edge of housing 12, antenna feed F3 may be activated when device 10 is held by the user's right hand, and antenna feed F2 may be activated when device 10 is held by the user's left hand. Antenna ground plane 104 and slot 114 may have any desired shape. For example, ground plane 104 may have an extended portion that is closer to peripheral structures 16 than other portions of ground plane 104. Slot 114 may, for example, have a U-shape or other meandering shape that runs around the extended portion of ground plane 104 between ground plane 104 and peripheral structures 16. Antenna 40 may have any desired number of resonances in any desired frequency bands. In the example of FIG. 7, antenna 40L is formed as the lower antenna in region 20 of device 10 (FIG. 1). If desired, the structures of FIG. 7 may also be used to form upper antennas 40U, 40U-1, and 40U-2 in upper antenna in region 22 of device 10 or an antenna at any other desired location within device 10. Other structures may be used to form antennas 40U, 40U-1, and 40U-2 if desired.

The state or operating mode of the antenna structures within region 20 (and the wireless operating mode of circuitry 34 and device 10) may be given by the particular settings that are used for components T0-T7 at a given time (e.g., which feeds are active, which return paths are used, and/or how the resonances of the antenna structures are tuned). In one suitable arrangement, the antenna structures in region 20 (e.g., device 10 or circuitry 34) may have at least first, second, third, and fourth operating modes or states. In the first operating mode (e.g., a so-called low band right hand mode or state), components T0-T7 may be configured to form antenna 40L and antenna feed F2 may be used to convey radio-frequency signals over antenna 40L. In the second operating mode (e.g., a so-called low band left hand mode or state), components T0-T7 may be configured to form antenna 40L and antenna feed F3 may be used to convey radio-frequency signals over antenna 40L.

In the third operating mode (e.g., a so-called first MIMO midband (MB) mode or state), components T0-T7 may be configured to form antennas 40L-1 and 40L-2, with feed F4 conveying radio-frequency signals over antenna 40L-1 and feed F1 conveying radio-frequency signals over antenna 40L-2 at one or more of the same frequencies. In the third operating mode, additional short circuit paths may be coupled into use for antennas 40L-1 and 40L-2. In the fourth operating mode (e.g., a so-called second MIMO midband (MB) mode or state), components T0-T7 may also be configured to form antennas 40L-1 and 40L-2, with feed F4 conveying radio-frequency signals over antenna 40L-1 and feed F1 conveying radio-frequency signals over antenna 40L-2 at one or more of the same frequencies. However, when placed in the fourth operating mode, antennas 40L-1 and 40L-2, the additional short circuit paths associated with the third operating mode may form open circuits.

FIGS. 8-11 show illustrative examples of the electrical components that may be used in forming adjustable components T0-T7 of FIG. 7 and that may be adjusted to place device 10 into a selected one of the low band left hand mode, low band right hand mode, first MIMO MB mode, and second MIMO MB mode.

Figure 8:
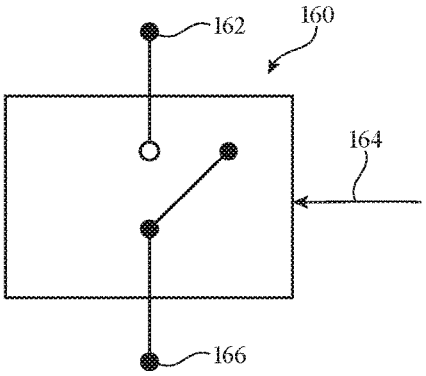
FIG. 8 is a diagram of an illustrative switch that may be used in antenna structures in accordance with an embodiment.

FIG. 8 is a circuit diagram showing an illustrative switch that may be used in forming one or more of components T0-T7 of FIG. 7. As shown in FIG. 8, switch 160 may be coupled between switch terminals 162 and 166. Control circuitry 28 may adjust switch 160 using control signals 164 to place switch 160 in an open or closed state. In one suitable arrangement, switches such as switch 160 may be used to form components T1 and T6 of FIG. 7 (e.g., switch terminal 162 may be coupled to feed terminal 98-4 or 98-1 whereas switch terminal 166 may be coupled to point 124 or point 142 on structures 16). In these scenarios, when switch 160 is turned on (closed), the corresponding feed F may be active. When switch 160 is turned off (open), the corresponding feed F may be inactive (deactivated). Switch 160 may be, for example, a single-pole single-throw (SPST) switch.

Figure 9:
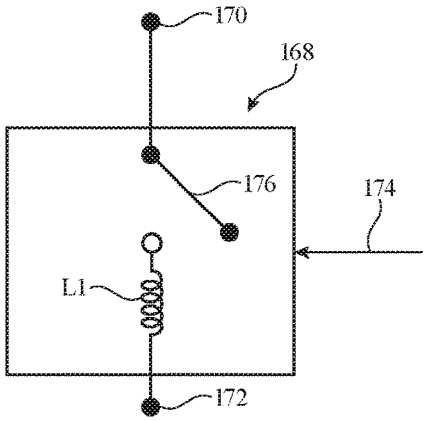
FIG. 9 is a diagram of an illustrative adjustable single-element inductor that may be used in antenna structures in accordance with an embodiment.

FIG. 9 is a circuit diagram of an illustrative switchable inductor that may be used in forming one or more of components T0-T7 of FIG. 7. As shown in FIG. 9, adjustable component 168 may include inductor L1 coupled in series with switch 176 between a first component terminal 170 and a second component terminal 172. Switch 176 may be, for example, a single-pole single-throw (SPST) switch. Adjustable component 168 can be adjusted to produce different amounts of inductance between component terminals 170 and 172. Component 168 may therefore sometimes be referred to herein as adjustable inductor or switchable inductor circuitry 168. Control circuitry 28 may control switch 176 using control signals 174. When switch 176 is placed in a closed state, inductor L1 is switched into use and adjustable inductor 168 exhibits an inductance L1 between component terminals 170 and 172. When switch 176 is placed in an open state, inductor L1 is switched out of use and adjustable inductor 168 exhibits an essentially infinite amount of inductance between component terminals 170 and 172.

In one suitable arrangement, adjustable components such as adjustable component 168 may be used to form components T7, T5, T2, and/or T0 of FIG. 7 (e.g., component terminal 170 may be coupled to points 120, 126, 140, or 146 on ground plane 104 whereas component terminal 172 may be coupled to points 122, 128, 138, or 144 on structures 16). In these scenarios, when switch 176 is turned on, a return path having inductance L1 for antenna 40L, 40L-1, or 40L-2 may be coupled between structures 16 and ground 104. Switch 176 may be toggled to adjust the frequency response of antenna 40L, 40L-1, or 40L-2 in high band HB, midband MB, and/or low midband LMB, if desired.

Figure 10:
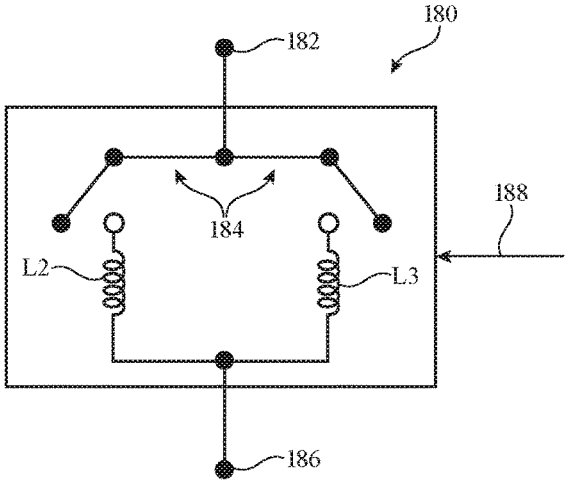
FIG. 10 is a diagram of an illustrative multi-element inductor that may be used in antenna structures in accordance with an embodiment.

FIG. 10 is a circuit diagram showing circuit elements that may be used in forming one or more of components T0-T7 of FIG. 7. As shown in FIG. 10, adjustable component 180 may include multiple inductors that are used in providing an adjustable amount of inductance between component terminals 182 and 186 (e.g., component 168 may sometimes be referred to as an adjustable inductor or adjustable inductor circuitry). Control circuitry 28 may adjust adjustable inductor circuitry 180 to produce different amounts of inductance between component terminals 182 and 186 by controlling the state of switching circuitry such as switch 184 using control signals 188. Switch 184 may be, for example, a single-pole double-throw (SP2T) switch.

Control signals on path 188 may be used to switch inductor L2 into use between component terminals 182 and 186 while switching inductor L3 out of use, may be used to switch inductor L3 into use between component terminals 182 and 186 while switching inductor L2 out of use, may be used to switch both inductors L2 and L3 into use in parallel between component terminals 182 and 186, or may be used to switch both inductors L2 and L3 out of use to form an open circuit between component terminals 182 and 186.

The switching circuitry arrangement of adjustable inductor 180 of FIG. 10 is therefore able to produce one or more different inductance values, two or more different inductance values, three or more different inductance values, or, if desired, four different inductance values (e.g., L2, L3, L2 and L3 in parallel, or infinite inductance when L2 and L3 are switched out of use simultaneously). In one suitable arrangement, adjustable components such as adjustable component 180 may be used to form components T7, T5, T2, and/or T0 of FIG. 7 (e.g., component terminal 182 may be coupled to points 120, 126, 140, or 146 on ground plane 104 whereas component terminal 186 may be coupled to points 122, 128, 138, or 144 on structures 16). In these scenarios, when one or more of inductors L2 and L3 are coupled between component terminals 182 and 186, a return path having a corresponding inductance for antenna 40L, 40L-1, or 40L-2 may be coupled between structures 16 and ground 104. Switch 184 may be toggled to adjust the frequency response of antenna 40L, 40L-1, or 40L-2 in high band HB, midband MB, and/or low midband LMB, if desired.

Figure 11:
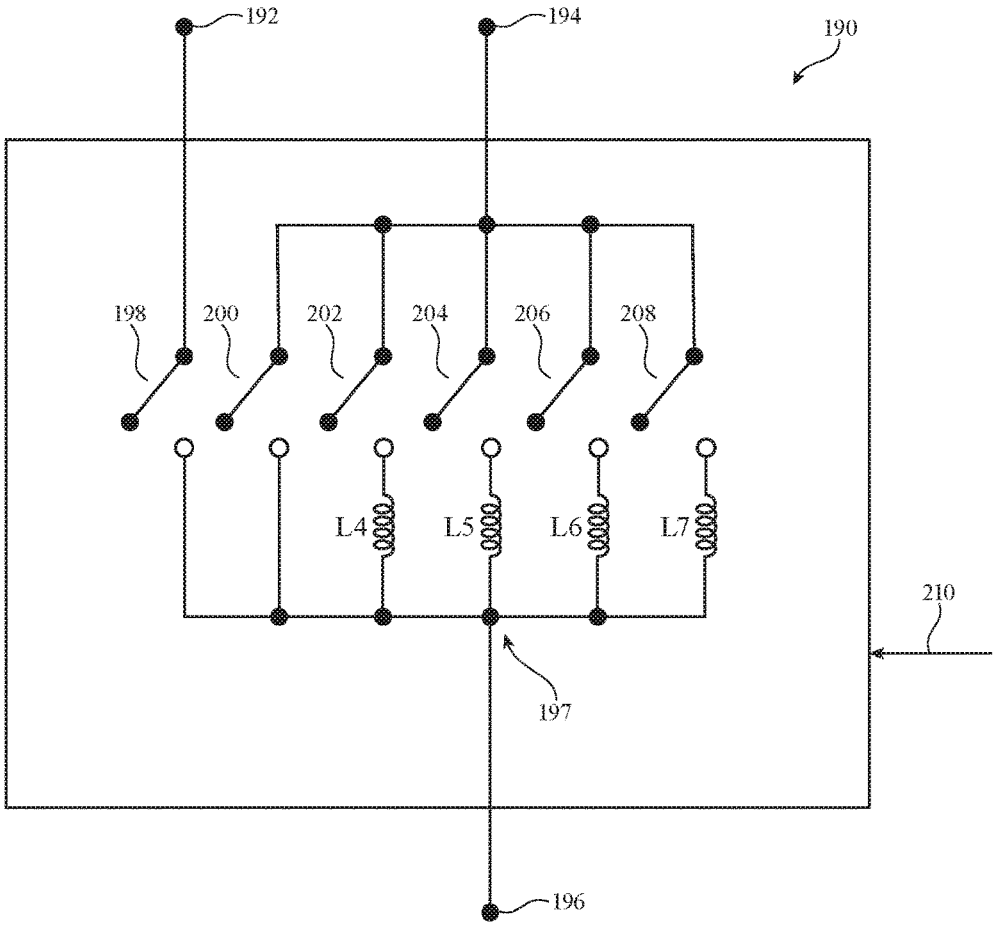
FIG. 11 is a diagram of illustrative switchable inductor circuitry that may be coupled to an antenna feed in accordance with an embodiment.

FIG. 11 is a circuit diagram showing a three terminal component that may be used in forming one or both of components T3 and T4 of FIG. 7. As shown in FIG. 11, adjustable component 190 may include a first switch (e.g., an SPST switch) 198 coupled between component terminal 192 and circuit node 197. Component 190 may include inductor L4 coupled in series with second switch 202, inductor L5 coupled in series with switch 204, inductor L6 coupled in series with switch 206, inductor L7 coupled in series with switch 208, and switch 200 coupled in parallel between component terminal 194 and circuit node 197. Circuit node 197 may be coupled to component terminal 197. Inductors L4-L7 may be used in providing an adjustable amount of inductance between component terminals 194 and 196. Control circuitry 28 may adjust component 190 to produce different amounts of inductance between component terminals 194 and 196 by controlling the state of switches 200-208. Control circuitry 28 may close switch 198 to couple component terminal 192 to component terminal 196 (and terminal 194 when one or more of switches 200-208 is closed) and may open switch 198 to decouple component terminal 192 from component terminal 196.

In one suitable arrangement, adjustable component 190 may be used to form components T3 or T4 of FIG. 7 (e.g., component terminal 192 may form switch port P3 coupled to feed terminal 98-3 or may form switch port P6 coupled to feed 98-2, component terminal 194 may form switch port P2 coupled to ground point 130 or may form switch port P5 coupled to ground point 134, and component terminal 196 may form switch port P1 coupled to resonating element point 132 or may form switch port P4 coupled to resonating element point 136). In these scenarios, switches 200-208 may be used to provide a selected shunt inductance from the path between component terminals 192 and 196 and ground 104 when the corresponding feed F is active and/or to provide an adjustable return path inductance when the corresponding feed F is inactive. Different combinations of switches 200-208 may be opened or closed to adjust the shunt inductance. Adjusting the shunt inductance may, for example, be used to adjust the frequency response of antenna 40L in low band LB if desired.

If desired, adjustable component 190 may have a first state at which component terminal 192 is coupled to component terminal 196. In this first state, the corresponding feed F may be active and, if desired, switches 200-208 may be used to adjust the shunt inductance for the corresponding feed (e.g., to adjust the resonance of antenna 40L in low band LB). In another suitable arrangement, each of switches 200-208 may be open in this state. Component 190 may have a second state at which component terminal 192 is decoupled from component terminal 196 but component terminal 194 is coupled to component terminal 196 through one or more of switches 200-208. In this second state, the corresponding feed F may be inactive and a return path for antenna 40L-1 or 40L-2 may be formed between terminals 194 and 196. If desired, switches 200-208 may be adjusted to tweak the inductance of the return path. Component 190 may have a third state at which all of switches 198 and 200-208 are open, thereby forming an open circuit between component terminals 192, 194, and 196, and deactivating the corresponding feed F.

The example of FIG. 11 is merely illustrative. In general, there may be any desired number of inductors coupled in parallel between terminals 194 and 196. The examples of FIGS. 8-11 are merely illustrative. In general, adjustable components 160, 168, 180, and 190 (e.g., components T0-T7 of FIG. 7) may each include any desired number of inductive, capacitive, resistive, and switching elements arranged in any desired manner (e.g., in series, in parallel, in shunt configurations, etc.). Control circuitry 28 may adjust components T0-T7 (e.g., the switching circuitry in components 170, 178, 180, and 190 of FIGS. 8-11) to place the antenna structures in region 20 within a selected one of the low band right hand mode, low band left hand mode, first MIMO MB mode, and second MIMO MB mode. Components T0-T7 of FIG. 7 may include combinations of these components or other components arranged in any desired manner between structures 16 and ground 104.

While the arrangement of FIG. 7 may provide a satisfactory amount of isolation between antennas 40L-1 and 40L-2 when placed in the first or second MIMO MB modes of operation, if desired, antennas 40L-1 and 40L-2 may be further isolated by mechanically separating resonating element arm 108-1 of antenna 40L-1 from antenna resonating element arm 108-2 of antenna 40L-2.

Figure 12:
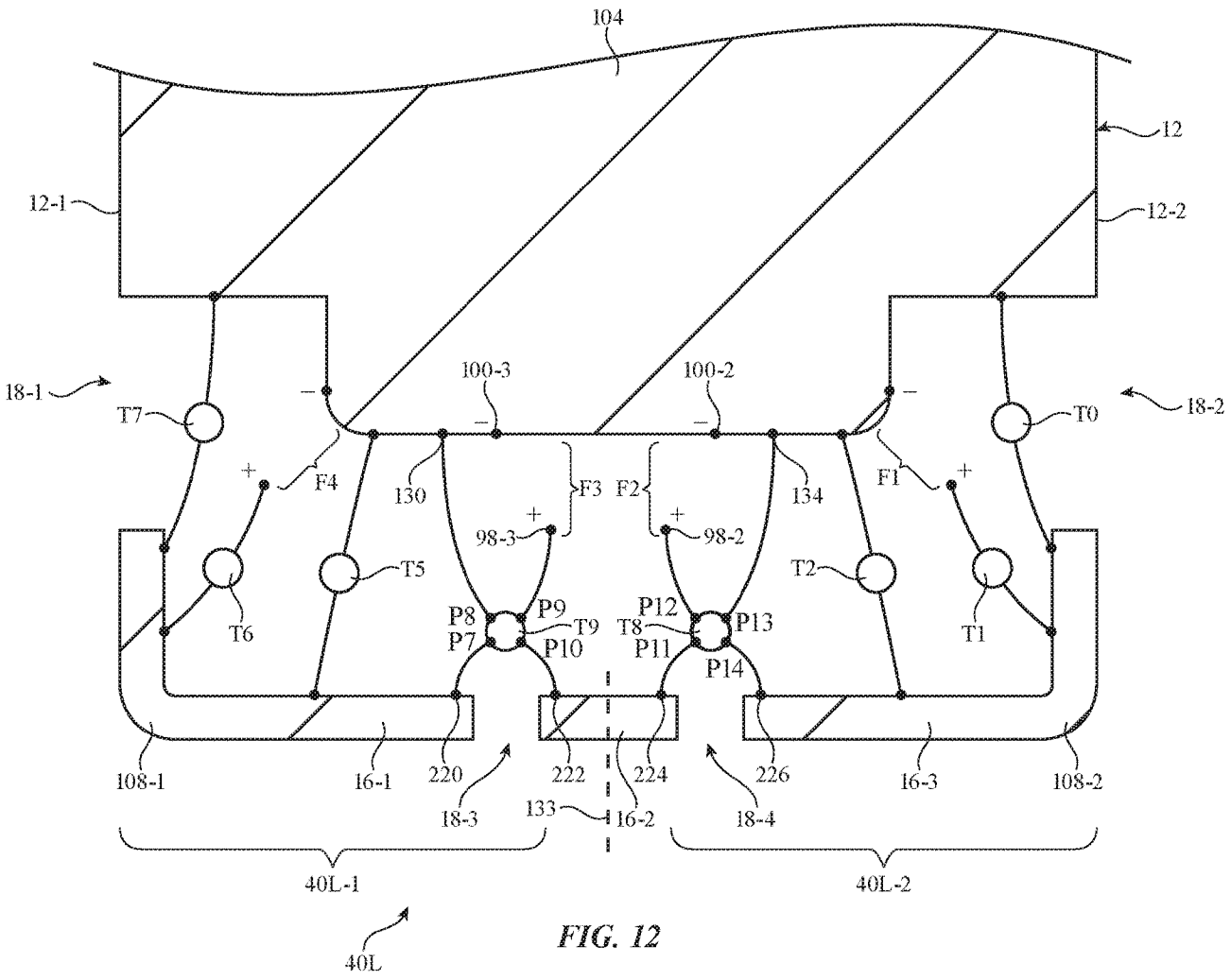
FIG. 12 is a diagram of illustrative antenna structures having dielectric gaps for enhancing electromagnetic isolation between multiple antennas in accordance with an embodiment.

FIG. 12 is a diagram showing how antennas 40L-1 and 40L-2 may be formed from slot and inverted-F antenna structures and from mechanically separated portions of device housing 16. As shown in FIG. 12, one or more gaps 18 (FIG. 1) such as gap 18-3 and gap 18-4 may separate peripheral conductive housing structures 16 into a first segment 16-1 extending between gaps 18-1 and 18-3, a second segment 16-2 extending between gaps 18-3 and 18-4, and a third segment 16-3 extending between gaps 18-4 and 18-2. Resonating element arm 108-1 of antenna 40L-1 may be formed from segment 16-1. Resonating element arm 108-2 of antenna 40L-2 may be formed from segment 16-3.

When configured using an arrangement of the type shown in FIG. 12, adjustable component T9 may be used in place of adjustable component T4 and adjustable component T8 may be used in place of adjustable component T3 of FIG. 7. Adjustable component T8 may, for example, include multi-port switching circuitry having a first switch port (terminal) P11, a second switch port P12, a third switch port P13, and a fourth switch port P14. Switch port P11 may be coupled to point 224 on segment 16-2 of housing structures 16. Switch port P14 may be coupled to point 226 on segment 16-3 of housing structures 16. Switch port P13 may be coupled to point 134 on ground plane 104. Switch port P12 may be coupled to feed terminal 98-2 of feed F2.

The switching circuitry in component T8 may have a first state at which port P12 is coupled to both ports P11 and P14, a second state at which port P14 is coupled to port P13, and a third state at which port P11 is coupled to port P14. This is merely illustrative and, if desired, component T8 may have other or additional states and may have fewer or additional ports. When component T8 is in the first state, feed terminal 98-2 may be coupled to points 226 and 224 and feed F2 may be active for antenna 40L (e.g., antenna currents handled by feed F2 may flow from feed terminal 98-2 and over both segments 16-2 and 16-3 via ports P11 and P14). When component T8 is in the second state, a return path for antenna 40L-2 is formed between point 226 on segment 16-3 and point 134 on ground plane 104, feed terminal 98-2 is decoupled from structures 16, and feed F2 is inactive. When component T8 is in the third state, feed terminal 98-2 is decoupled from structures 16, feed F2 is inactive, feed F3 may be active, and the resonating element arm for antenna 40L (e.g., fed using feed F3) may include both segments 16-2 and 16-3 (e.g., antenna currents handled by feed F3 may flow through ports P11 and P14 of component T8).

The switching circuitry in component T9 may have a first state at which port P9 is coupled to both ports P7 and P10, a second state at which port P7 is coupled to port P8, and a third state at which port P7 is coupled to port P10. This is merely illustrative and, if desired, component T9 may have other or additional states and may have fewer or additional ports. When component T9 is in the first state, feed terminal 98-3 may be coupled to points 220 and 222 and feed F3 may be active for antenna 40L (e.g., antenna currents handled by feed F3 may flow from feed terminal 98-3 over both segments 16-2 and 16-1 via ports P7 and P10). When component T9 is in the second state, a return path for antenna 40L-1 is formed between point 220 on segment 16-1 and point 130 on ground plane 104, feed terminal 98-3 is decoupled from structures 16, and feed F3 is inactive. When component T9 is in the third state, feed terminal 98-3 is decoupled from structures 16, feed F3 is inactive, feed F2 may be active, and the resonating element arm for antenna 40L (e.g., fed using feed F2) may include both segments 16-1 and 16-2 (e.g., antenna currents handled by feed F2 may flow through ports P7 and P10 of component T9).

As an example, when operated in the low band right hand operating mode, component T8 may be placed in its first state (so that feed F2 is active) and component T9 may be placed in its third state to couple port P7 to port P10. This may allow antenna currents for feed F2 to flow over all three segments 16-1, 16-2, and 16-3. The length of segments 16-1 and 16-2 may be associated with a resonance of antenna 40L in low band LB. Moving the low band coverage to the left of axis 133 in this example may mitigate any low band detuning due to the presence of the user's palm adjacent to side 12-2 of device 10, for example. The length of segment 16-3 between gap 18-4 and gap 18-2 (or the length between point 226 and component T2 or component T0) may be associated with resonances of antenna 40L in midband MB and/or low midband LMB. A portion of slot 114 extending between feed F2 and gap 18-2 or between feed F2 and gap 18-1 may be associated with a resonance of antenna 40L in high band HB, as an example.

When operated in the low band left hand operating mode, component T9 may be placed in the first state (so that feed F3 is active) and component T8 may be placed in the third state to couple port P7 to port P10. This may allow antenna currents for feed F3 to flow over all three segments 16-1, 16-2, and 16-3. The length of segments 16-2 and 16-3 may be associated with a resonance of antenna 40L in low band LB. Moving the low band coverage to the right of axis 133 in this example may mitigate any low band detuning due to the presence of the user's palm adjacent to side 12-1 of device 10, for example. The length of segment 16-1 between gap 18-3 and gap 18-1 (or the length between point 220 and component T5 or component T7) may be associated with resonances of antenna 40L in midband MB and/or low midband LMB. A portion of slot 114 extending between feed F3 and gap 18-1 or between gap 18-2 and feed F3 may be associated with a resonance of antenna 40L in high band HB, as an example.

When operated in the first or second MIMO MB modes of operation, both components T9 and T8 may be in their respective second states, forming short circuits between segment 16-1 and ground point 130 and between segment 16-3 and ground point 134, respectively. The presence of the mechanical separation provided by gaps 18-3 and 18-4, as well as the shorting of antenna currents for antenna 40L-1 to ground 104 at point 130 and antenna currents for antenna 40L-2 to ground 104 at point 134 may serve to electromagnetically isolate antennas 40L-1 and 40L-2 (e.g., to prevent interference between the antenna currents for antennas 40L-1 and 40L-2). The degree of electromagnetic isolation may, for example, be greater than in scenarios where no gaps such as gaps 18-3 and 18-4 are formed between gaps 18-1 and 18-2 (e.g., as shown in FIG. 7). On the other hand, forming arm 108 of antenna 40L without any gaps as shown in FIG. 7 may enhance the aesthetic appearance and structural integrity of housing walls 16 relative to scenarios where gaps 18-3 and 18-4 are formed, as shown in FIG. 12.

If desired, resistive, capacitive, and/or inductive components arranged in any desired manner may also be formed within components T9 and T8. For example, components T8 and T9 may include adjustable capacitors and/or inductors that may be adjusted by control circuitry 28 to tune the frequency responses of antennas 40L, 40L-1, and/or 40L-2. In one suitable arrangement, an adjustable shunt inductance (e.g., as shown in FIG. 11) may be formed in components T9 and/or T8 for adjusting the response of antenna 40L in low band LB.

Figure 13:
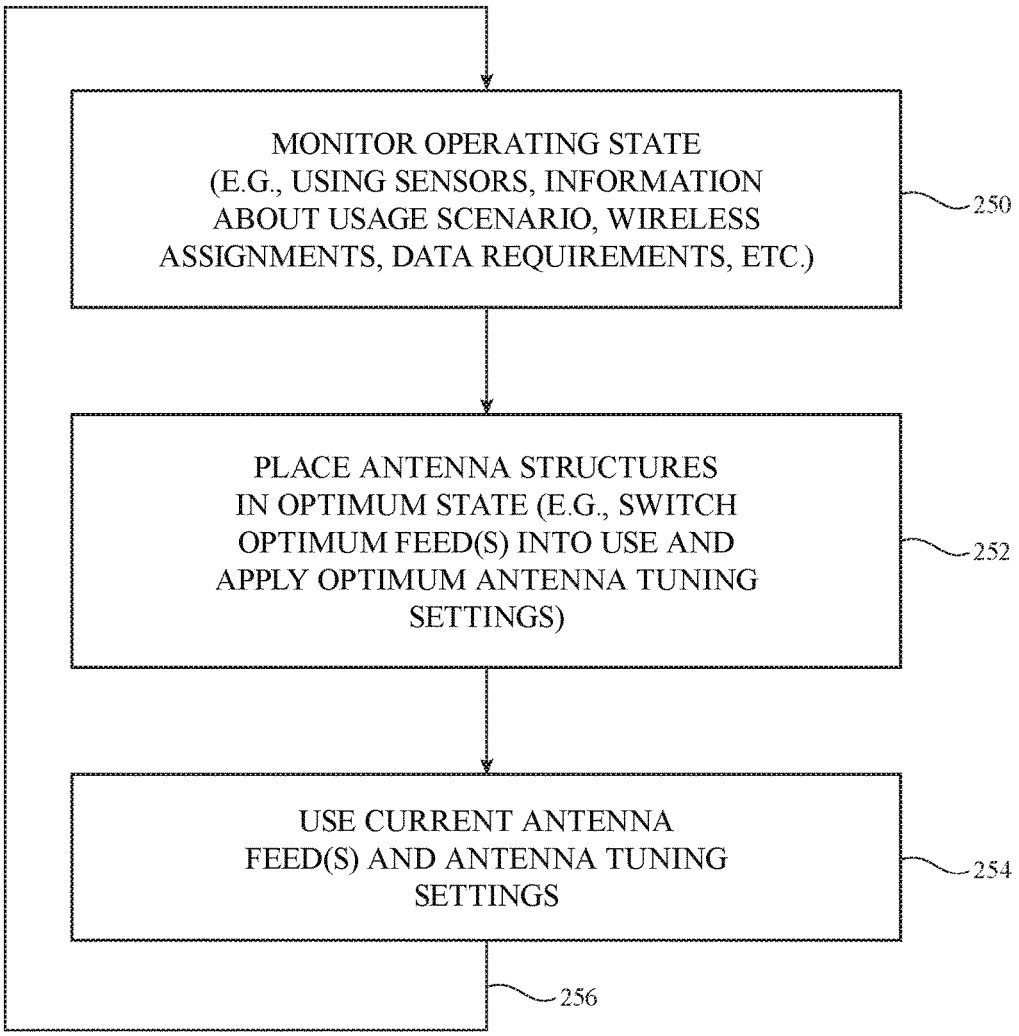
FIG. 13 is a flow chart of illustrative steps that may be involved in operating an electronic device having antenna structures of the type shown in FIGS. 7-12 in accordance with an embodiment.

In order to ensure that antenna 40 operates satisfactorily regardless of the operating conditions of device 10 and regardless of whether a user is holding device 10 with their right or left hand, control circuitry 28 may determine which type of device operating environment is present and may adjust components T0-T7 of antenna 40L accordingly to compensate. FIG. 13 is a flow chart of illustrative steps involved in operating device 10 to ensure satisfactory performance for antenna 40L in all desired frequency bands of interest. The steps of FIG. 13 may, for example, be used to adjust components T0-T7 between the low band left hand mode, low band right hand mode, first MIMO MB mode, and second MIMO MB mode.

At step 250 of FIG. 13, control circuitry 28 may monitor the operating environment (state) of device 10. Control circuitry 28 may, in general, use any suitable type of sensor measurements, wireless signal measurements, operation information, or antenna measurements to determine how device 10 is being used (e.g., to determine the operating environment of device 10). For example, control circuitry 28 may use sensors such as antenna impedance sensors that gather impedance data such as complex phase and magnitude information associated with antennas 40L, 40L-1, and/or 40L-2 using directional couplers coupled to transmission lines 50, temperature sensors, capacitive proximity sensors, light-based proximity sensors, resistance sensors, force sensors, touch sensors, connector sensors that sense the presence of a connector in a connector port on device 10 or that detect the presence or absence of data transmission through the connector port, sensors that detect whether wired or wireless headphones are being used with device 10, sensors that identify a type of headphone or accessory device that is being used with device 10, or other sensors to determine how device 10 is being used.

If desired, control circuitry 28 may also use information from an orientation sensor such as an accelerometer in device 10 to help determine whether device 10 is being held in a position characteristic of right hand use or left hand use (or is being operated in free space). Control circuitry may also use information about a usage scenario of device 10 in determining how device 10 is being used (e.g., information identifying whether audio data is being transmitted through ear speaker 26 of FIG. 1, information identifying whether a telephone call is being conducted, information identifying whether a microphone on device 10 is receiving voice signals, etc.).

If desired, control circuitry 28 may identify frequency bands that are to be used for wireless communications. For example, control circuitry 28 may identify the frequency bands that are assigned to device 10 for communications (e.g., by external equipment such as a wireless base station or access point or by communications software running on control circuitry 28). As another example, control circuitry 28 may identify the frequency bands that are to be used based on the radio-frequency performance of device 10 (e.g., one or more frequency bands at which device 10 has optimal performance at a given time).

If desired, control circuitry 28 may identify a data throughput, data rate, or bandwidth requirement for device 10. Such a requirement may, for example, be dictated by operations that are being performed by device 10. For example, device 10 may identify when processing operations or other operations are being performed that may require more data be received from external equipment than other operations (e.g., streaming online video, performing complex cloud processing and storage operations, etc.). In general, any desired combination of one or more of these types of information may be processed by control circuitry 28 to identify how device 10 is being used (i.e., to identify the operating environment of device 10).

At step 252, control circuitry 28 may adjust the configuration of components T0-T7 based on the current operating environment of device 10 (e.g., based on data or information gathered while processing step 250). For example, control circuitry 28 may place components T0-T7 in an optimal one of the low band left hand mode, low band right hand mode, first MIMO MB mode, and second MIMO MB mode based on the information gathered while processing step 250. By configuring components T0-T7 in one of these operating modes, control circuitry 28 may ensure that wireless circuitry 34 operates satisfactorily regardless of how the user is holding device 10, regardless of the frequency bands that are to be used, and regardless of whether device 10 is performing operations that require a relatively low data rate or a relatively high data rate such as a data rate afforded by operating under a MIMO scheme.

Figure 14:
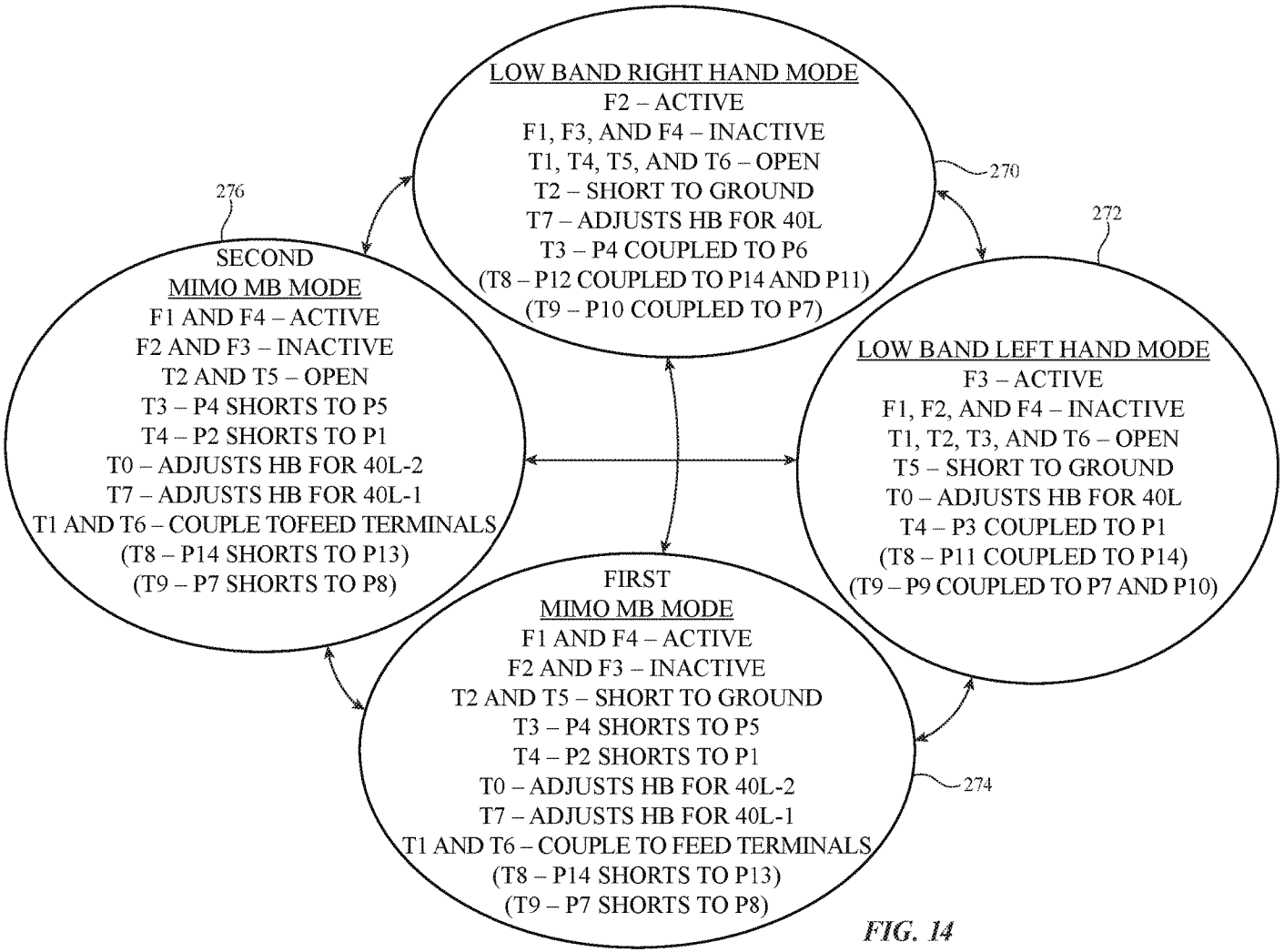
FIG. 14 is a state diagram showing illustrative wireless operating modes for an electronic device in accordance with embodiment.

A state diagram showing illustrative operating modes for device 10 (e.g., for circuitry 34 or the antenna structures in region 20 of device 10) is shown in FIG. 14. As shown in FIG. 14, device 10 may be operable in a low band right hand mode 270, a low band left hand head mode 272, a first MIMO MB mode 274, and a second MIMO MB mode 276. Control circuitry 28 may identify which mode is to be used based on the monitored operating conditions of device 10 (e.g., using the sensor data and other information gathered while processing step 250 of FIG. 13) and may adjust tunable components T0-T7 of FIGS. 7 and 12 to place device 10 in the corresponding operating mode.

When operating in low band right hand mode 270, control circuitry 28 may enable antenna feed F2 and may disable antenna feeds F1, F3, and F4. For example, control circuitry 28 may control component T3 of FIG. 7 to couple port P6 to port P4 and may control component T4 to form an open circuit between terminals P1, P2, and P3. Feed terminal 98-2 may thereby be coupled to point 136 and may convey radio-frequency signals for antenna 40L. Control circuitry 28 may control components T1, T5, and T6 to form open circuits between ground 104 and structures 16 (e.g., by opening corresponding switches of the types shown in FIGS. 8-11). Control circuitry may control component T2 to form a short circuit to ground 104 (e.g., by closing switches of the types shown in FIGS. 8-11). In scenarios where splits 18-3 and 18-4 are formed in structures 16 (FIG. 12), control circuitry 28 may control component T8 to couple port P12 to ports P11 and P14 and may control component T9 to couple port P7 to port P10. Component T0 may be placed in any desired state (e.g., because antenna currents are shorted to ground by element T2 prior to reaching component T0).

In this operating mode, antenna 40L may exhibit a resonance in low band LB associated with the length of structures 16 between feed F2 and gap 18-1, a resonance in midband MB and/or low midband LMB associated with the length of structures 16 between feed F2 and component T2, and/or a resonance in high band HB associated with slot 114. Control circuitry 28 may adjust the state of component T7 to tune the response of antenna 40L in high band HB. Control circuitry 28 may adjust the state of component T2 (e.g., by adjusting an inductance provided by component T2 as shown in FIGS. 9 and 10) to tune the response of antenna 40L in midband MB and/or low midband LMB. Control circuitry 28 may adjust a shunt inductance of component T3 (e.g., as shown in FIG. 11) to tune the response of antenna 40L in low band LB if desired.

When configured in low band right hand mode 270, antenna 40L may convey radio-frequency signals in low band LB, low midband LMB, midband MB, and/or high band HB with satisfactory antenna efficiency, even if a user's hand (e.g., right hand) loads antenna 40L from side 12-2 of housing 12. However, if a user's hand (e.g., left hand) loads antenna 40L from side 12-1 of housing 12, antenna 40L may have reduced antenna efficiency when conveying radio-frequency signals in mode 270. When configured in mode 270, antenna 40U at the opposing end of device 10 may operate at the same frequencies as antenna 40L or at different frequencies 40L. If antenna 40L and 40U operate at one or more of the same frequencies, antennas 40U and 40L may perform communications using a MIMO scheme (e.g., a 2×MIMO scheme) at one or more of those frequencies to increase the data throughput of circuitry 34 relative to scenarios where only a single antenna is used (e.g., to twice the data rate of the single antenna or greater, depending on the number of frequencies used for the MIMO scheme).

Control circuitry 28 may place device 10 into mode 270 in response to certain operating conditions of device 10 (e.g., as determined using the sensor data and other information gathered while processing step 250 of FIG. 13). As one example, control circuitry 28 may place device 10 in one of modes 270 and 272 in response to determining that communications in low band LB is desired (e.g., when a frequency in low band LB is assigned to device 10 for communications using external base station equipment or by software on running on circuitry 28, when sensor circuitry identifies that radio-frequency performance of circuitry 34 is optimized in low band LB, etc.). Sensor circuitry such as proximity sensor circuitry or antenna impedance measurement circuitry may subsequently determine whether a user's hand or other external object is adjacent to side 12-1 or side 12-2 of housing 12. In response to determining that the user's hand is adjacent to side 12-2, control circuitry 28 may place device 10 in operating mode 270. In response to determining that the user's hand is adjacent to side 12-1, control circuitry 28 may place device 10 in operating mode 272.

In another example, control circuitry 28 may identify a data throughput requirement for device 10. The data throughput requirement may, for example, be determined by the processing operations being performed by device 10 (e.g., some operations may require more wireless data be conveyed per second with external equipment than others). In response to determining that a relatively low data throughput requirement is present (e.g., that the required data throughput, data rate, or data bandwidth is less than a threshold value), control circuitry 28 may place device 10 in one of modes 270 or 272. Operating in modes 270 and 272 may, for example, involve greater antenna efficiency in one or more frequency bands than in modes where antennas 40L-1 and 40L-2 are used (e.g., because antenna 40L occupies a larger volume than antennas 40L-1 or 40L-2). Sensor circuitry such as proximity sensor circuitry or antenna impedance measurement circuitry may subsequently determine whether a user's hand or other external object is adjacent to side 12-1 or side 12-2 of housing 12. In response to determining that the user's hand is adjacent to side 12-2, control circuitry 28 may place device 10 in operating mode 270. In response to determining that the user's hand is adjacent to side 12-1, control circuitry 28 may place device 10 in operating mode 272.

When operating in low band left hand mode 272, control circuitry 28 may enable antenna feed F3 and may disable antenna feeds F1, F2, and F4. For example, control circuitry 28 may control component T4 of FIG. 7 to couple port P3 to port P1 and may control component T3 to form an open circuit between terminals P4, P5, and P6. Feed terminal 98-3 may thereby be coupled to point 132 and may convey radio-frequency signals for antenna 40L. Control circuitry 28 may control components T1, T2, and T6 to form open circuits between ground 104 and structures 16 (e.g., by opening corresponding switches such as the switches shown in FIGS. 8-11). Control circuitry may control component T5 to form a short circuit to ground 104 (e.g., by closing switches of the types shown in FIGS. 8-11). In scenarios where splits 18-3 and 18-4 are formed in structures 16 (FIG. 12), control circuitry 28 may control component T9 to couple port P9 to ports P7 and P10 and may control component T8 to couple port P11 to port P14. Component T7 may be placed in any desired state (e.g., because antenna currents are shorted to ground by element T5 prior to reaching component T7).

In this operating mode, antenna 40L may exhibit a resonance in low band LB associated with the length of structures 16 between feed F3 and gap 18-2, a resonance in midband MB and/or low midband LMB associated with the length of structures 16 between feed F3 and component T5, and/or a resonance in high band HB associated with slot 114. Control circuitry 28 may adjust the state of component T0 to tune the response of antenna 40L in high band HB. Control circuitry 28 may adjust the state of component T5 (e.g., by adjusting an inductance provided by component T5 as shown in FIGS. 9 and 10) to tune the response of antenna 40L in midband MB and/or low midband LMB. Control circuitry 28 may adjust a shunt inductance of component T4 (e.g., as shown in FIG. 11) to tune the response of antenna 40L in low band LB if desired.

When configured in low band left hand mode 272, antenna 40L may convey radio-frequency signals in low band LB, low midband LMB, midband MB, and/or high band HB with satisfactory antenna efficiency, even if a user's hand (e.g., left hand) loads antenna 40L from side 12-1 of housing 12. However, if a user's hand (e.g., right hand) loads antenna 40L from side 12-2 of housing 12, antenna 40L may have reduced antenna efficiency when conveying radio-frequency signals in mode 272. When configured in mode 272, antenna 40U at the opposing end of device 10 may operate at the same frequencies as antenna 40L or at different frequencies 40L. If antenna 40L and 40U operate at one or more of the same frequencies, antennas 40U and 40L may perform communications using a MIMO scheme (e.g., a 2×MIMO scheme) at one or more of those frequencies to increase the data throughput of circuitry 34 relative to scenarios where only a single antenna is used (e.g., to twice the data rate of the single antenna or greater, depending on the number of frequencies used for the MIMO scheme).

Control circuitry 28 may place device 10 into mode 272 in response to certain operating conditions of device 10 (e.g., as determined using the sensor data and other information gathered while processing step 250 of FIG. 13). As one example, control circuitry 28 may place device 10 into mode 272 in response to determining that communications in low band LB is desired or that a relatively high data throughput associated with 4×MIMO operations is not required and in response to determining that the user's hand or other external objects are adjacent to side 12-1 of housing 12, for example.

When in first MIMO MB mode 274, control circuitry 28 may enable antenna feeds F1 and F4 and may disable antenna feeds F2 and F3. This may configure the structures in region 20 to form antennas 40L-1 and 40L-2 instead of a single antenna 40L. For example, control circuitry 28 may control component T4 of FIG. 7 to short port P2 to port P1 and may control component T3 to short port P4 to P5. Forming return paths to points 130 and 134 in this way may short any stray antenna currents from feeds F1 and F2 to ground 104, thereby serving to electromagnetically isolate antennas 40L-1 and 40L-2 despite antennas 40L-1 and 40L-2 having resonating element arms formed from the same continuous piece of conductor 16.

Control circuitry 28 may control component T1 to short terminal 98-1 to point 142 and may control component T6 to short terminal 98-4 to point 124. This may allow antenna currents conveyed by feed F4 of antenna 40L-1 to flow over resonating element arm 108-1 and may allow antenna currents conveyed by feed F1 of antenna 40L-2 to flow over resonating element arm 108-2. Control circuitry 28 may control component T2 to form a short circuit to ground 104 for antenna 40L-2 (e.g., by closing switches of the types shown in FIGS. 8-11). Control circuitry 28 may control component T5 to form a short circuit to ground 104 for antenna 40L-1. In scenarios where splits 18-3 and 18-4 are formed in structures 16 (FIG. 12), control circuitry 28 may control component T9 to couple port P7 to port P8 and may control component T8 to couple port P13 to port P14 (e.g., to form isolating return paths between segments 16-1 and 16-3 and ground 104).

In this operating mode, antennas 40L-1 and 40L-2 may have insufficient volume for covering low band LB. Antennas 40L-1 and 40L-2 may, however, concurrently convey radio-frequency signals at the same frequencies in midband MB and/or high band HB. For example, the response of antenna 40L-1 in midband MB may be associated with the length of structures 16 between feed F4 and the return path formed by component T5. The response of antenna 40L-2 in midband MB may be associated with the length of structures 16 between feed F1 and the return path formed by component T2. The response of antenna 40L-1 in high band HB may be associated with a portion of slot 114 between arm 108-1 and ground 104. The response of antenna 40L-2 in high band HB may be associated with a portion of slot 114 between arm 108-2 and ground 104. Control circuitry 28 may adjust the state of component T0 to tune the response of antenna 40L-1 in high band HB and may adjust the state of component T7 to tune the response of antenna 40L-2 in high band HB. Control circuitry 28 may adjust the state of component T5 to tune the response of antenna 40L-1 in midband MB and may adjust the state of component T2 to tune the response of antenna 40L-2 in midband MB, if desired.

When configured in first MIMO MB mode 274, antennas 40L-1 and 40L-2 may concurrently convey radio-frequency signals in midband MB and/or high band HB using a MIMO scheme and with a greater throughput than when antenna 40L is used. When configured in mode 274, antennas 40U-1 and 40U-2 at the opposing end of device 10 may operate at the same frequencies as antennas 40L-1 and 40L-2 or at different frequencies. If antennas 40L-1, 40L-2, 40U-1, and 40U-2 operate at one or more of the same frequencies, antennas 40U-1, 40U-2, 40L-1, and 40L-2 may concurrently convey signals at the same frequencies using a 4×MIMO scheme. If antennas 40U-1 and 40U-2 (or antenna 40U) operate at different frequencies from antennas 40L-1 and 40L-2, antennas 40L-1 and 40L-2 may concurrently convey signals at the same frequencies using a 2×MIMO scheme if desired.

Control circuitry 28 may place device 10 into mode 274 in response to certain operating conditions of device 10 (e.g., as determined using the sensor data and other information gathered while processing step 250 of FIG. 13). As one example, control circuitry 28 may place device 10 into modes 274 or 276 in response to determining that communications in low band LB are not desired and/or that a relatively high data throughput is required (e.g., in scenarios where the processing operations of circuitry 28 require a greater data throughput than a predetermined threshold value that cannot be satisfied using only a single antenna). Control circuitry 28 may place device 10 in mode 274 in response to determining that short circuits between points 128 and 126 and between points 140 and 138 are desired (e.g., when communications towards the lower end of midband MB and low midband LMB are not required).

When in second MIMO MB mode 276, control circuitry 28 may enable antenna feeds F1 and F4 and may disable antenna feeds F2 and F3. This may configure the structures in region 20 to form antennas 40L-1 and 40L-2 instead of a single antenna 40L. For example, control circuitry 28 may control component T4 of FIG. 7 to short port P2 to port P1 and may control component T3 to short port P4 to P5. Forming return paths to points 130 and 134 in this way may short antenna currents from feeds F1 and F2 to ground 104, thereby serving to electromagnetically isolate antennas 40L-1 and 40L-2 despite antennas 40L-1 and 40L-2 having resonating element arms formed from the same continuous piece of conductor 16.

Control circuitry 28 may control component T1 to short terminal 98-1 to point 142 and may control component T6 to short terminal 98-4 to point 124. This may allow antenna currents conveyed by feed F4 of antenna 40L-1 to flow over resonating element arm 108-1 and may allow antenna currents conveyed by feed F1 of antenna 40L-2 to flow over resonating element arm 108-2. Control circuitry 28 may control component T2 to form an open circuit between ground 104 and structures 16 (e.g., by opening switches of the types shown in FIGS. 8-11). Control circuitry 28 may control component T5 to form an open circuit between ground 104 and structures 16. In scenarios where splits 18-3 and 18-4 are formed in structures 16 (FIG. 12), control circuitry 28 may control component T9 to couple port P7 to port P8 and may control component T8 to couple port P13 to port P14 (e.g., to form isolating return paths between segments 16-1 and 16-3 and ground 104).

In this operating mode, antennas 40L-1 and 40L-2 may have insufficient volume for covering low band LB. Antennas 40L-1 and 40L-2 may, however, concurrently convey radio-frequency signals in low midband LMB, midband MB and/or high band HB. For example, the response of antenna 40L-1 in low midband LMB and midband MB may be associated with the length of structures 16 between feed F4 and the return path formed by component T4 (or T9 in the example of FIG. 12). The response of antenna 40L-2 in low midband LMB and midband MB may be associated with the length of structures 16 between feed F1 and the return path formed by component T3 (or T8 in the example of FIG. 12). The response of antenna 40L-1 in high band HB may be associated with a portion of slot 114 between arm 108-1 and ground 104. The response of antenna 40L-2 in high band HB may be associated with a portion of slot 114 between arm 108-2 and ground 104. Control circuitry 28 may adjust the state of component T0 to tune the response of antenna 40L-1 in high band HB and may adjust the state of component T7 to tune the response of antenna 40L-2 in high band HB. Control circuitry 28 may adjust inductance and/or capacitance of component T4 (T9) to tune the response of antenna 40L-1 in low midband LMB and midband MB and may adjust the inductance and/or capacitance of component T3 (T8) to tune the response of antenna 40L-2 in low midband LMB and midband MB if desired.

When configured in second MIMO MB mode 276, antennas 40L-1 and 40L-2 may concurrently convey radio-frequency signals in low midband LMB, midband MB, and/or high band HB using a MIMO scheme and with a greater throughput than when antenna 40L is used. When configured in mode 276, antennas 40U-1 and 40U-2 at the opposing end of device 10 may operate at the same frequencies as antennas 40L-1 and 40L-2 or at different frequencies. If antennas 40L-1, 40L-2, 40U-1, and 40U-2 operate at one or more of the same frequencies, antennas 40U-1, 40U-2, 40L-1, and 40L-2 may concurrently convey signals at the same frequencies using a 4×MIMO scheme. If antennas 40U-1 and 40U-2 (or antenna 40U) operate at different frequencies from antennas 40L-1 and 40L-2, antennas 40L-1 and 40L-2 may concurrently convey signals at the same frequencies using a 2×MIMO scheme if desired.

Control circuitry 28 may place device 10 into mode 276 in response to detecting certain operating conditions of device 10 (e.g., as determined using the sensor data and other information gathered while processing step 250 of FIG. 13). As one example, control circuitry 28 may place device 10 into mode 276 in response to determining that communications in low band LB are not desired (or that a data throughput that is greater than supported by a single antenna 40L is required) or in response to determining that communications in midband MB is required, and in response to determining that open circuits are desired between points 128 and 126 and between points 138 and 140 (e.g., when device 10 is assigned a frequency near the lower end of band MB or in band LMB for communications). In this way, control circuitry 28 may switch device 10 between modes 270, 272, 274, and 276 to ensure that device 10 has satisfactory data throughput and antenna efficiency regardless of the operating requirements and environment of device 10.

The example of FIG. 14 is merely illustrative. If desired, the antenna structures in region 20 may be operated in more than four operating modes or fewer than four operating modes. Similar operating modes may be used for operating antennas 40U, 40U-1, and 40U-2 of FIG. 3 or different operating modes may be used for antennas 40U, 40U-1, and 40U-2 if desired.

Figure 15:
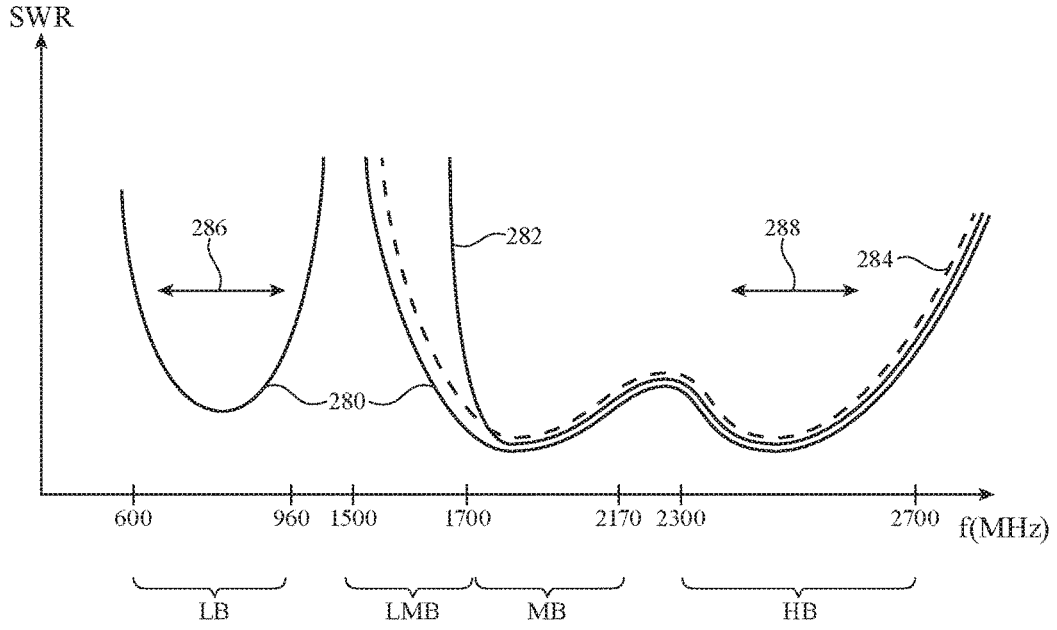
FIG. 15 is a graph in which antenna performance (standing-wave ratio) has been plotted as a function of operating frequency for antenna structures of the type shown in FIGS. 7-12 in accordance with an embodiment.

FIG. 15 is a graph in which antenna performance (standing wave ratio) has been plotted as a function of operating frequency f for antennas 40L, 40L-1, and 40L-2 of FIGS. 7 and 12. As shown in FIG. 15, curve 280 plots the performance of antenna 40L when device 10 is placed in low band right hand mode 270 or low band left hand mode 272 of FIG. 14. When operating in modes 272 or 270, antenna 40L may exhibit resonances (responses) at frequencies in low band LB, low midband LMB, midband MB, and high band HB. The response of antenna 40L in low band LB may be adjusted using adjustable components T3, T4, T8, T9, or other components as shown by arrow 286. The response of antenna 40L in high band HB may be adjusted using adjustable components T0 or T7 as shown by arrow 288.

Curve 282 plots the performance of either of antennas 40L-1 and 40L-2 when operating using first MIMO MB mode 274 of FIG. 14. When operating in mode 274, antennas 40L-1 and 40L-2 may exhibit resonances in midband MB and high band HB. The response of antenna 40L-1 in high band HB may be adjusted using adjustable component T7 and the response of antenna 40L-2 in high band HB may be adjusted using adjustable component T0 as shown by arrow 286.

Dashed curve 284 plots the performance of either of antennas 40L-1 and 40L-2 when operating using second MIMO MB mode 276 of FIG. 14. When operating in mode 276, antennas 40L-1 and 40L-2 may exhibit resonances in midband MB with a tweaked response relative to first MIMO MB mode 276 (e.g., extending the response towards the lower end of midband MB) and in high band HB. The response of antenna 40L-1 in high band HB may be adjusted using adjustable component T7 and the response of antenna 40L-2 in high band HB may be adjusted using adjustable component T0 as shown by arrow 286.

In the example of FIG. 15, low band LB extends from 600 MHz to 960 MHz, low midband LMB extends from 1500 MHz to 1700 MHz, midband MB extends from 1700 MHz to 2170 MHz, and high band HB extends from 2300 MHz to 2700 MHz. This is merely illustrative and, in general, bands LB, LMB, MB, and HB may include any desired frequencies (e.g., where low midband LMB is higher than low band LB, midband MB is higher than low midband LMB, and high band HB is higher than midband MB). In general, performance curves 280, 282, and 284 may have any desired shape. Antennas 40L, 40L-1, and 40L-2 may exhibit responses in more than four frequency bands, in fewer than three frequency bands, or in any other desired frequency bands if desired. Antennas 40L, 40L-1, and 40L-2 may exhibit narrowband resonances within bands LB, low midband LMB, midband MB, and/or high band HB or may exhibit broadband resonances extending across substantially all of the respective bands LB, LMB, MB, and/or HB. Similar performance curves may also be used to characterize antennas 40U, 40U-1, and 40U-2 of FIG. 3 if desired.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having peripheral conductive structures;

first and second gaps in the peripheral conductive structures that define a segment of the peripheral conductive structures;

an antenna ground;

a first antenna feed coupled between a first location on the segment and the antenna ground;

a second antenna feed coupled between a second location on the segment and the antenna ground;

a third antenna feed coupled between a third location on the segment and the antenna ground, wherein the second location is interposed between the first and third locations on the segment;

a plurality of adjustable components coupled to the segment; and control circuitry, wherein the control circuitry is configured to adjust the plurality of adjustable components to place the electronic device in a selected one of a first operating mode in which the first and third antenna feeds are active and the second antenna feed is inactive and a second operating mode in which the second antenna feed is active and the first and third antenna feeds are inactive.

2. The electronic device defined in claim 1, further comprising:

a fourth antenna feed coupled between a fourth location on the segment and the antenna ground, wherein the fourth location is interposed between the second and third locations.

3. The electronic device defined in claim 2, wherein the control circuitry is configured to adjust the plurality of adjustable components to place the electronic device in a third operating mode in which the fourth antenna feed is active and the first, second, and third antenna feeds are inactive, the fourth antenna feed being inactive in the first and second operating modes.

4. The electronic device defined in claim 3, wherein the second antenna feed comprises a first positive feed terminal and the fourth antenna feed comprises a second positive feed terminal, wherein the plurality of adjustable components comprises:

a first adjustable component coupled between the first positive feed terminal and the second location on the segment; and a second adjustable component coupled between the second positive feed terminal and the fourth location on the segment.

5. The electronic device defined in claim 4, wherein the first adjustable component forms a first short circuit path between the second location on the segment and the antenna ground and the second adjustable component forms a second short circuit path between the fourth location on the segment and the antenna ground in the first operating mode.

6. The electronic device defined in claim 5, wherein the plurality of adjustable components further comprises:

a third adjustable component coupled between a fifth location on the segment and the antenna ground, the fifth location being interposed between the first and second locations on the segment; and a fourth adjustable component coupled between a sixth location on the segment and the antenna ground, the sixth location being interposed between the third and fourth locations on the segment.

7. The electronic device defined in claim 6, wherein the third adjustable component forms a third short circuit path between the fifth location on the segment and the antenna ground and the fourth adjustable component forms an open circuit between the sixth location on the segment and the antenna ground in the second operating mode.

8. The electronic device defined in claim 7, wherein the fourth adjustable component forms a fourth short circuit path between the sixth location on the segment and the antenna ground and the third adjustable component forms an open circuit between the fifth location on the segment and the antenna ground in the third operating mode.

9. The electronic device defined in claim 6, wherein the control circuitry is configured to adjust the plurality of adjustable components to place the electronic device in a fourth operating mode in which the first and third antenna feeds are active and the second and fourth feeds are inactive, wherein the third adjustable component forms a short circuit between the fifth location on the segment and the antenna ground and the fourth adjustable component forms a short circuit between the sixth location on the segment and the antenna ground in the first operating mode, and the third and fourth adjustable components form open circuits between the segment and the antenna ground the fourth operating mode.

10. The electronic device defined in claim 5, further comprising:

third and fourth gaps in the segment of the peripheral conductive structures, wherein the second adjustable component shorts the second positive feed terminal to opposing sides of the third gap and the first adjustable component shorts opposing sides of the fourth gap in the second operating mode, and the first adjustable component shorts the first positive feed terminal to opposing sides of the fourth gap and the second adjustable component shorts opposing sides of the third gap in the third operating mode.

11. The electronic device defined in claim 5, further comprising:

radio-frequency transceiver circuitry in the housing and configured to concurrently convey radio-frequency signals over the first and third antenna feeds at a given frequency using a multiple-input and multiple-output (MIMO) antenna scheme in the first operating mode.

12. An electronic device, comprising:

a housing having peripheral conductive structures;

an antenna ground;

a first antenna that includes a first resonating element formed from a segment of the peripheral conductive structures extending between first and second dielectric-filled gaps in the peripheral conductive structures, a first antenna feed, and the antenna ground;

a second antenna that includes a second resonating element formed from a first portion of the first resonating element, a second antenna feed, and the antenna ground;

a third antenna that includes a third resonating element formed from a second portion of the first resonating element that is different from the first portion, a third antenna feed, and the antenna ground, wherein the electronic device is operable in a first mode of operation in which the first feed is enabled and the second and third feeds are disabled and in a second mode of operation in which the second and third feeds are enabled and the first feed is disabled; and first and second adjustable components coupled between the segment and the antenna ground, wherein the first and second adjustable components are configured to form respective first and second short circuit paths between the segment and the antenna ground in the second mode of operation.

13. The electronic device defined in claim 12, wherein the first antenna feed comprises first and second feed terminals, the second feed terminal is coupled to the antenna ground, the first adjustable component is configured to short the first feed terminal to the segment in the first mode of operation, and the second adjustable component is configured to form an open circuit between the segment and the antenna ground in the first mode of operation.

14. The electronic device defined in claim 13, wherein the first antenna includes a fourth feed that is disabled in the first and second modes of operation and the electronic device is operable in a third mode of operation in which the fourth feed is enabled and the first, second, and third feeds are disabled.

15. The electronic device defined in claim 14, further comprising:

sensor circuitry that gathers sensor data; and control circuitry, wherein the control circuitry is configured to place the electronic device in a selected one of the first and third modes of operation based on the gathered sensor data.

16. The electronic device defined in claim 12, wherein the first antenna is configured to convey radio-frequency signals in a first frequency band, a second frequency band that is higher than the first frequency band, and a third frequency band that is higher than the second frequency band in the first operating mode, and the second and third antennas are configured to concurrently convey radio-frequency signals at the same set of frequencies within the second and third frequency bands in the second operating mode.

17. The electronic device defined in claim 16, wherein the first frequency band comprises frequencies from 600 MHz to 960 MHz, the second frequency band comprises frequencies from 1500 MHz to 2170 MHz, and the third frequency band comprises frequencies from 2300 MHz to 2700 MHz.

18. The electronic device defined in claim 12, further comprising:

third and fourth dielectric-filled gaps in the segment of the peripheral conductive housing structures, wherein the first portion of the first resonating element extends from the first dielectric-filled gap to the third dielectric-filled gap, the second portion of the first resonating element extends from the second dielectric-filled gap to the fourth dielectric-filled gaps, the first adjustable component is configured to short opposing sides of the third dielectric-filled gap in the first mode of operation, and the second adjustable component is configured to short opposing sides of the fourth dielectric-filled gap in the first mode of operation.

19. Antenna structures, comprising:

an antenna resonating element arm having opposing first and second ends, the antenna resonating element arm being formed from a segment of peripheral conductive housing structures for an electronic device;

an antenna ground;

a first antenna feed coupled between a first location on the antenna resonating element arm and the antenna ground;

a first adjustable component coupled between a second location on the antenna resonating element arm and the antenna ground, the first location being interposed between the second location and the first end of the antenna resonating element arm;

a second antenna feed coupled between a third location on the antenna resonating element arm and the antenna ground;

a third antenna feed coupled between a fourth location on the antenna resonating element arm and the antenna ground; and a second adjustable component coupled between a fifth location on the antenna resonating element arm and the antenna ground, the third and fourth locations being interposed between the second and fifth locations on the antenna resonating element arm.

20. The electronic device defined in claim 19, further comprising:

a fourth antenna feed coupled between a sixth location on the antenna resonating element arm and the antenna ground, the sixth location being interposed between the fifth location and the second end of the antenna resonating element arm;

a third adjustable component coupled between a seventh location on the antenna resonating element arm and the antenna ground, the seventh location being interposed between the first location and the first end of the antenna resonating element arm; and a fourth adjustable component coupled between an eighth location on the antenna resonating element arm and the antenna ground, the eighth location being interposed between the sixth location and the second end of the antenna resonating element arm, wherein the first and fourth antenna feeds are configured to concurrently convey radio-frequency signals at the same frequency and a selected one of the second and third antenna feeds is configured to convey radio-frequency signals while the first and fourth antenna feeds are disabled.

* * * * *